United States Patent [19]

McInerny

[11] 3,944,210

[45] Mar. 16, 1976

[54] TICKET COUNTER AND ENDORSER

[75] Inventor: George P. McInerny, Andalusia, Pa.

[73] Assignee: Pennsylvania Research Associates, Inc., Cornwells Heights, Pa.

[22] Filed: Apr. 30, 1974

[21] Appl. No.: 465,700

[52] U.S. Cl. ..... 271/4; 271/35; 271/118; 271/122

[51] Int. Cl.[2] ..... B65H 3/04

[58] Field of Search ..... 271/4, 6, 7, 35, 118, 122, 271/125, 166, 270

[56] References Cited

UNITED STATES PATENTS

| | | | |
|---|---|---|---|
| 1,866,847 | 7/1932 | Finfrock | 271/35 |
| 2,812,179 | 11/1957 | Gleason | 271/118 |
| 3,612,512 | 10/1971 | Lang | 271/35 |
| 3,771,783 | 11/1973 | McInerny | 271/125 |
| 3,795,395 | 5/1974 | Ransom et al. | 271/4 |

FOREIGN PATENTS OR APPLICATIONS

| | | | |
|---|---|---|---|
| 680,569 | 2/1964 | Canada | 271/35 |

*Primary Examiner*—John J. Love
*Assistant Examiner*—Robert Saifer
*Attorney, Agent, or Firm*—Ostrolenk, Faber, Gerb & Soffen

[57] ABSTRACT

Apparatus for counting and endorsing documents and more particularly tickets dimensionally within the preferred range from 1 inch by 2 inches to 2 inches by 5.5 inches and in the thickness range from two mils to 14 mils. The stack of tickets is placed in an in-feed hopper and is engaged by an eccentric bottom feed picker to drive preferably the bottom-most document toward a drive wheel and stripper wheel assembly to permit documents to pass only in single file beyond the stripper device. The documents are fed in single file between cooperating belts until they are picked up by acceleration means which abruptly accelerates the documents to provide a gap therebetween suitable for counting purposes.

The documents are driven into a stacker wherein they are stacked in the same order in which they were loaded into the in-feed hopper. A stacker arm provides pressure on the building stack which pressure is continually reduced as the stack increases in height to assure a smooth stacking operation. The stacker back plate is adjustable to accommodate the documents of different lengths. A single drive belt is utilized to feed, drive and convey documents to the acceleration means.

The documents may be endorsed by selectively moveable endorsing means arranged to prevent "back printing." A novel split retainer mechanism is utilized to facilitate fast removal and replacement of the endorser, ink roller and the endorser drum, while at the same time providing the capability of retaining and locking these elements in place during use.

19 Claims, 35 Drawing Figures

35
33
33a 33e
33b
33a
33c
33d
18

18a 34g
34c
34d
34e 34g
34b
34a
36
34f 18c
18b
18
18c
18b 32
23a
23b
29b
26c
19
18
25
28
26
32e
32d
23c
11a
35
29a 39
40
27
30
31
18
19
28
25
133
26

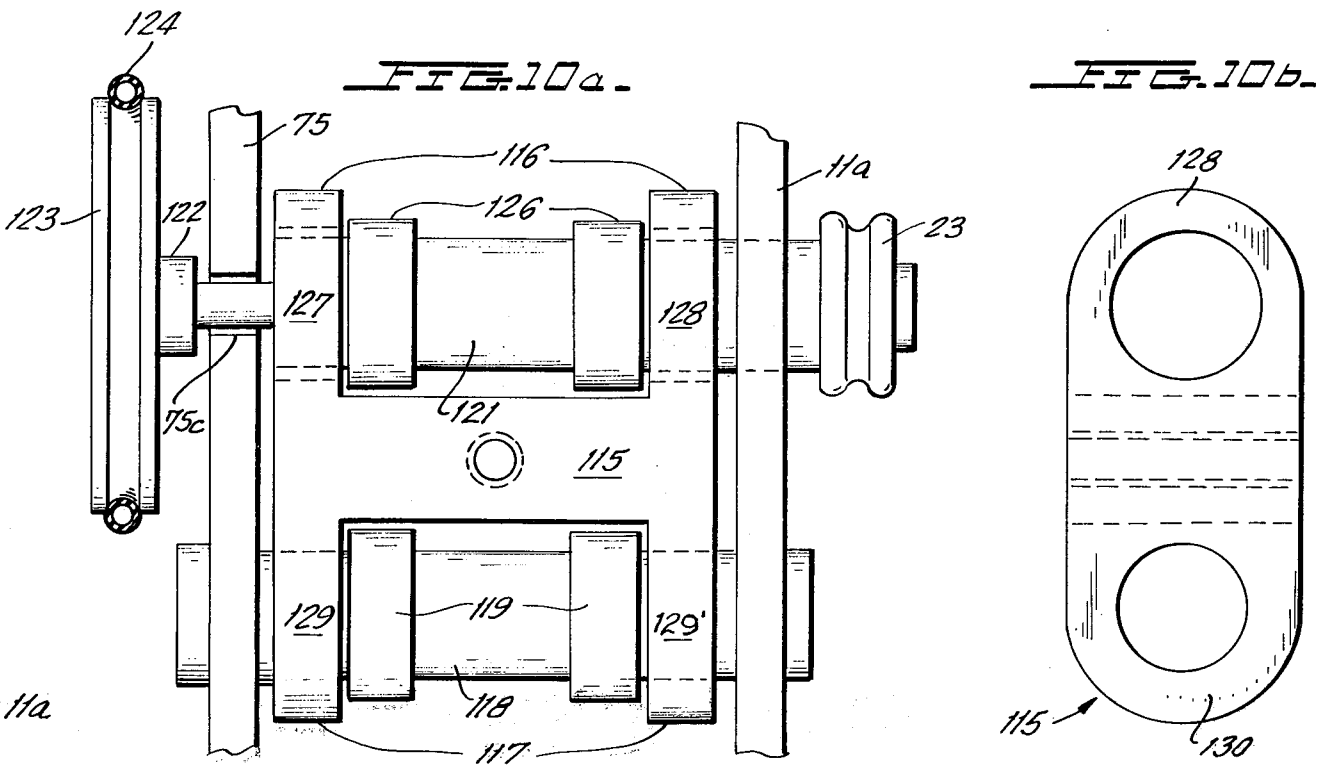
FIG. 10b.
FIG. 10a.
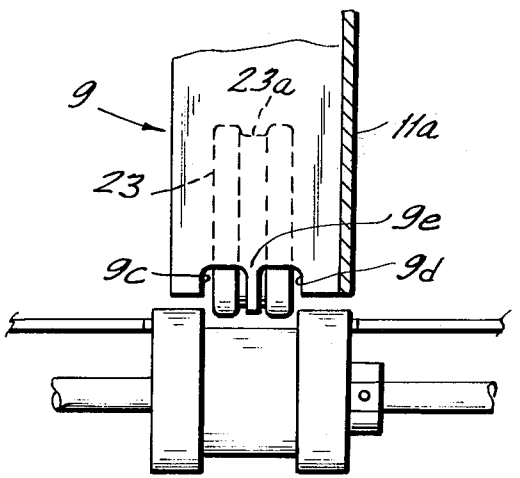
FIG. 9.

STACKER BELT
CLUTCH
BRAKE

TICKET COUNTER AND ENDORSER

BACKGROUND OF THE INVENTION

There exist a large number of applications wherein it is desired to provide a capability of counting and/or endorsing or cancelling documents such as tickets. Since many applications require counting devices having a capability of counting tickets accurately and at high speeds, apparatus is required which not only meets these specifications, but is further capable of counting and stacking tickets of which many may be mutilated or creased due to folding or rough handling. Typically, damaged or mutilated tickets must first be removed from a stack due to the fact that present day feeding and separating devices are incapable of counting such tickets. Even tickets which may be perfectly intact but which may be either severely folded or creased typically require special handling.

It is also desirable to provide apparatus capable of performing the above mentioned functions and which is further designed to accommodate tickets of varying length, width, thickness and finishes, as well as being capable of handling tickets formed of different materials and thicknesses which may be creased either slightly or severely or have slight or severe tears.

BRIEF DESCRIPTION

The present invention is characterized by providing a device for feeding, separating, counting and stacking tickets and which is simple in design and yet is capable of feeding and separating tickets of different thicknesses, weight, dimensions, finishes and materials, while at the same time being capable of providing an accurate count of a stack of such tickets with the feeding, separation, counting and stacking operations occurring at speeds not heretofore obtainable through conventional apparatus, as well as being capable of stacking tickets so as to maintain the same order in which they are fed into the machine.

The present invention comprises an infeed hopper for depositing a large stack of tickets which may include tickets within the stack of dissimilar size, thickness, weight and finish. The operator need not exercise any special care in forming a stack of such tickets so as to greatly simplify the use of the equipment.

The infeed hopper is provided with an inclined support whose lower end terminates to expose a closed loop feed belt entrained about an eccentric picker idler which provides the dual functions of advancing at least the bottommost sheet in the stack towards stripping and separating apparatus while at the same time, due to its eccentric mounting, serving to "jostle" or "jog" the stack which further facilitates separation of tickets within the stack as they are fed towards stripping and separating apparatus. The infeed hopper is provided with a configuration which causes the bottom-most group of tickets in the stack to be substantially relieved from the weight of the upper portion of the stack to provide a more positive picker operation.

The picker idler advances the bottom-most group of sheets toward a drive wheel, releasing the aforesaid group of tickets from the weight of the remainder of the stack at the rearward portion of the inclined support. The infeed hopper also includes a second inclined surface which supports the forward edges of the stacked tickets to further relieve the weight of the stack from the bottom few sheets. The sheets thus released are then free to slide downwardly along the support surface in order to come under the influence of drive and stripper means.

The drive means consists of the same endless belt having a toothed pattern therealong, and which is wrapped about a feed drum of large diameter. The aforesaid second inclined surface and a portion of the feed belt form a narrow throat region through which the bottom-most documents may pass.

A stripper wheel is mounted above the feed belt and rotates in a direction counter to that of the feed belt. The frictional force exerted upon a single document by the stripper roller is less than the frictional force exerted upon the single document by the feed belt, causing the document to be driven in the forward feed direction. However, if two (or more) documents are fed in over-lapping fashion between the feed belt and stripper roller, the frictional force between the two over-lapping tickets is less than the frictional force exerted upon the upper ticket by the stripper roller urging this document rearwardly and assuring feeding of only a single ticket beyond the stripper roller.

A guide deflector urges tickets passing in single file beyond the stripper roller into a curved path, defined by the large diameter feed drum and O-ring belts entrained about idler rollers. The O-ring belts and feed belts are entrained about an additional idler roller which define a substantially linear path portion which, after turning the tickets through an angle of the order of 180°, advances the tickets in single file toward acceleration means.

The idler rollers which define the output end of the feed path between the O-ring belts and the feed belt are spaced apart by an amount sufficient to cause the O-rings and feed belt to exert only light pressure upon the documents fed therebetween.

As the tickets leave the feed path defined by the feed belt and O-ring belts they move between an acceleration roller and cooperating acceleration idler roller to abruptly increase the linear speed of tickets of the order of 1.5 to two times the linear speed of the tickets as they approach the acceleration means. This abrupt acceleration forms a separation gap between the trailing edge of a leading document and the leading edge of the next trailing document, which gap is of a dimension sufficient to permit counting of the documents by a light source and cooperating photodetector device.

The documents, after passing through the acceleration means, are rapidly driven into a stacker having a stacker arm designed to hold documents down in the stacker. The arm is mounted to a rotatable cam which causes the arm to exert continually reduced pressure upon the stack as the stack of tickets grows in height. The overall weight exerted upon documents entering the stacker remains substantially constant since the decreasing pressure applied upon the stack by the stacker arm is compensated for by the weight of documents forming the stack.

Jam detector means is provided in the form of a micro-switch assemby designed to abruptly terminate the feeding of documents as a result of documents which are improperly fed to the stacker and which cause the stacker arm to kick upwardly at a velocity sufficient to cause the stacker arm to trip the micro-switch.

A stacker drive belt is entrained about a roller which forms a knee or bend in the path of movement of the drive belt to incline stacked tickets at an angle relative to the path of movement of the tickets entering the stacker so as to provide a gap sufficient for entry of a ticket into the stacker at the bottom end of the stack.

The stacker hopper is provided with an adjustable back stop designed to adjust the stacker to a length sufficient to accommodate tickets of varying length assuring the formation of a compact, neat stack of tickets.

Tickets may be endorsed during the counting operation by means of an endorser assembly comprised of an ink roll, an ink transfer roll and an endorser die which may all be moved into the operative position or alternatively moved into a disengaged position by means of an operating lever. The bands of printed matter provided on the endorser die are positioned immediately adjacent grooves provided in the feed belt to prevent the "back printing" of documents by preventing the transfer of ink from the endorser drum print bands to the feed belt. The ink roll, transfer roll and endorser die are all idlers which are given by O-rings which, in turn, are driven by the feed belt, thus greatly reducing the complexites of the drive train required for the apparatus.

Since it is typical to require rather frequent changing of the endorser ink roll and endorser drum, a novelsplit ring retainer assembly is provided for facilitating the removal and replacement of ink roll and endorser drum without requiring the removal of any components from the ticket counter.

The above described ticket counter has been found to accurately count tickets in the aforementioned size and thickness ranges at speeds of the order of 1,500 tickets per minute and if desired, has been found to be capable of counting tickets up to speeds in excess of 3,000 tickets per minute.

OBJECTS OF THE INVENTION

It is therefore one object of the present invention to provide novel apparatus for feeding, separating, counting and stacking tickets of dissimilar characteristics at speeds not heretofore attainable through conventional apparatus.

Another object of the present invention is to provide apparatus of feeding, separating and counting tickets of varying sizes, thicknesses and finishes and being capable of performing such operations in an accurate fashion even though tickets which are mutilitated are encountered during operation of the apparatus.

Still another object of the present invention is to provide a novel feeding and stripping assembly in which a single closed loop feed belt serves the combined functions of jogging the stack in the infeed conveyor, feeding the bottom-most documents toward a stripper assembly and passing these documents toward acceleration means whereby abrupt acceleration of the documents is made possible even before the tickets leave the influence of the feed belt.

Still another object of the present invention is to provide a novel stacker arrangement for stacking documents which have been counted wherein a novel pivotally mounted stacker arm is arranged to alter the pressure applied to a ticket stack being formed so that the weight exerted upon tickets entering the stacker and which is a function of the combined effects of the stacker arm and already stacked tickets, is substantially uniform during the entire stacking operation.

Still another object of the present invention is to provide novel jam detector means cooperating with a pivotally mounted stacker arm to abruptly turn off the machine under certain jam conditions.

Still another object of the present invention is to provide a novel endorsing assembly for use in the aforesaid ticket counter wherein the endorsing assembly may be selectively engaged or disengaged through operation of a single lever and wherein the feed belt serves the combined functions of acting as the backing means for tickets being endorsed while preventing the transfer of ink to the feed belt due to the provision of notched continuous grooves therein.

Still another object of the present invention is to provide a novel split retainer assembly which facilitates simple and yet rapid removal and replacement of the endorser assembly ink roll and/or endorser drum while avoiding the need for removal of any of the retaining components during either a removal or replacement operation.

Still another object of the present invention is to provide a novel stacker which may be readily adjusted to accommodate tickets of varying length while preventing tickets from passing beneath the stacker stop plate and which is provided with a stacker feed belt having a knee or bend which serves to form a clearance gap at the entrance of the stacker to assure proper entry and stacking of tickets therein without jamming.

BRIEF DESCRIPTION OF THE FIGURES

The above as well as other objects of the present invention will become apparent when reading the accompanying description and drawings in which:

FIG. 1 shows a perspective view of a ticket counter embodying the principles of the present invention.

FIG. 9 shows an elevational view of the infeed hopper plate of FIG. 1*a*.

FIG. 10*a* shows a top plan view of the stripper pivot arm assembly for mounting the stripper roller of FIG. 1*a*.

FIG. 10*b* shows an end view of the stripper arm of FIG. 10*a*.

FIG. 11*c* shows a detailed view of a portion of the feed belt and the endorser dye of FIG. 1*a*.

FIG. 12*a* and 12*b* show top and side views respectively of the ink roller and split retainer assembly employed for mounting the ink roller of FIG. 1*a*.

FIG. 12*c* shows the split retainer assembly and ink roller assembly of FIG. 12*b* with the ink roller in the removed position.

FIGS. 12*d* and 12*g* show detailed views of the split retainer assembly of FIGS. 12*a*–12*c* with the knurled nut respectively shown in the locked and disengaged positions.

FIG. 12*e* shows a top plan view of the split retainer halves embodied in the assembly of FIG. 12*d* for example.

FIG. 12*f* shows a detailed view of the knurled nut employed in the assemblies of FIGS. 12*a*–12*d* and 12*g*.

FIG. 13 shows the power train utilized in the ticket counter of FIG. 1*a*.

DETAILED DESCRIPTION OF THE INVENTION

Figure 7:
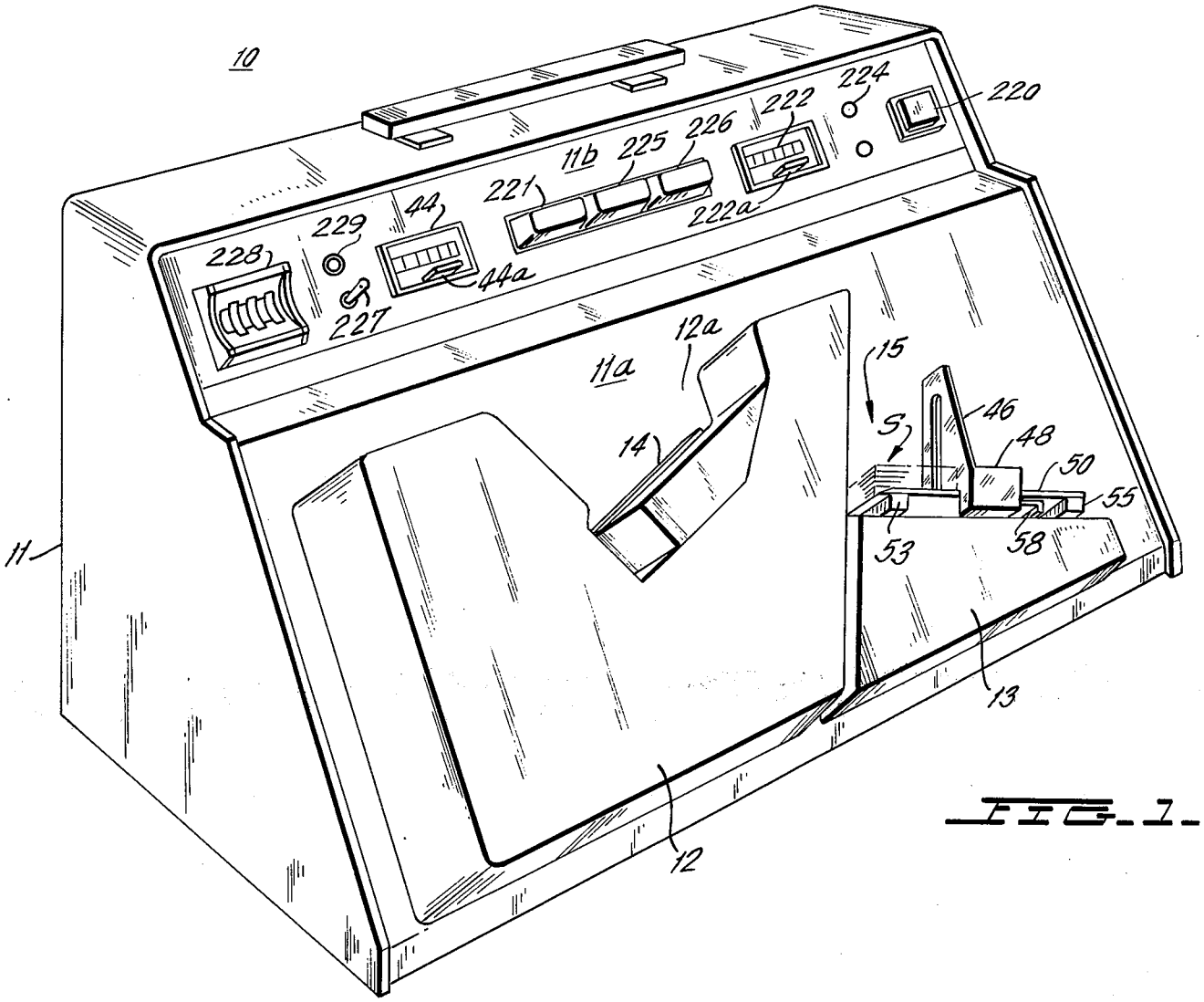
FIG. 7*a* shows a side view, partially sectionalized of the feed picker pulley and feed picker extension of FIG. 1*a*.
FIG. 7*b* shows an end view of the feed picker pulley of FIG. 7*a*.
Figure 1A:
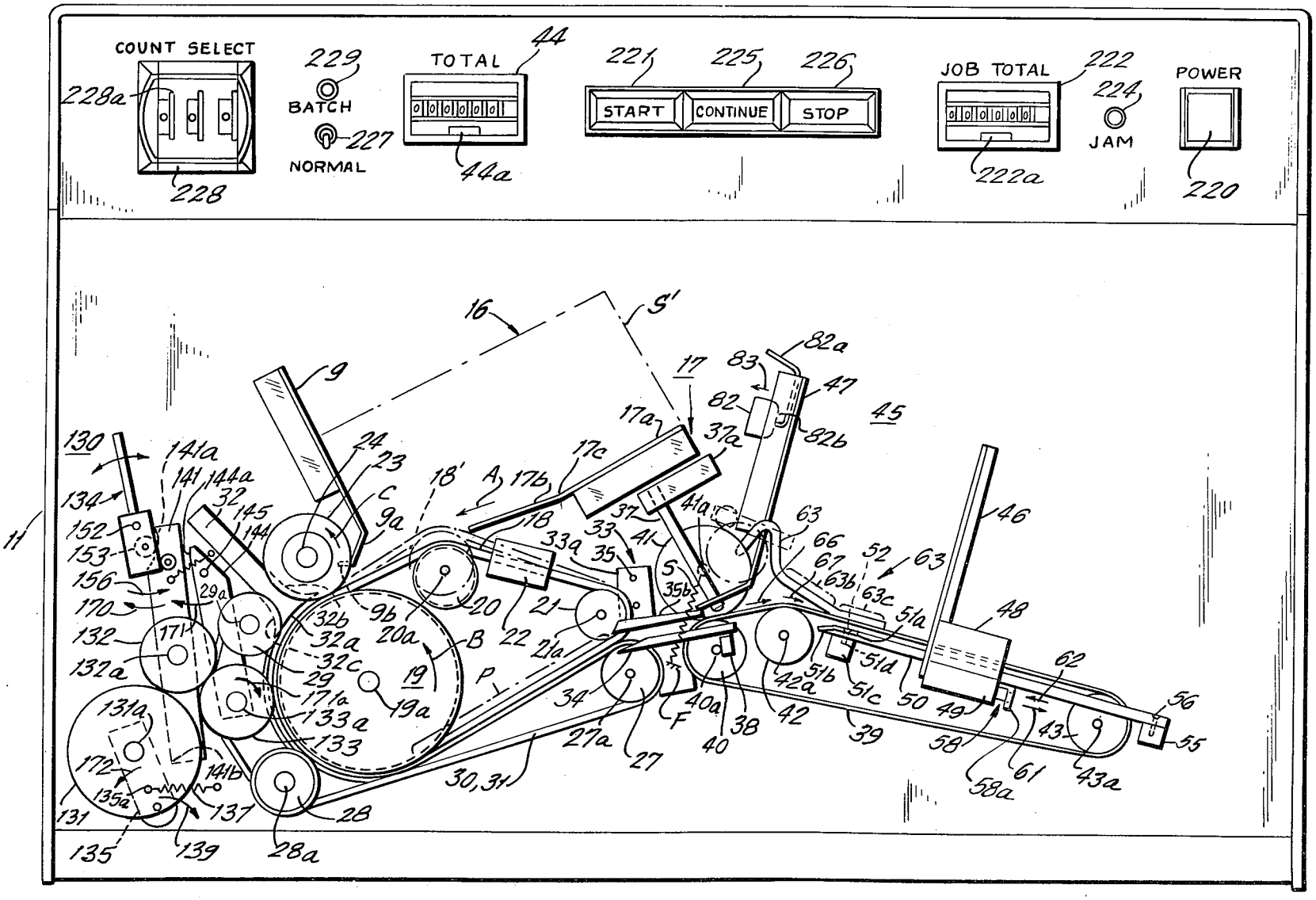
FIG. 1*a* shows an elevational view of the front face of the ticket counter of FIG. 1 with the cover plates removed.

Referring initially to FIGS. 1 and 1*a*, there is shown therein a ticket counter 10 comprised of a housing 11. The actual feeding, separating, counting and stacking mechanism occupies the region of diagonally aligned front face 11*a*. An upper portion 11*b* of the front face and set slightly back from portion 11*a* shows the various counters and operating switches for controlling operation of the mechanism in a manner to be more fully described.

The housing further consists of first and second hollow cover members 12 and 13 which serves to conceal portions of the mechanism which do not require exposure during normal operation of the equipment. However, cover 12 and 13 may be easily and readily moved for servicing, maintenance or other purposes.

Cover 12 has a recessed region 12*a* which forms the infeed hopper for receiving tickets such as, for example, the ticket 14, for counting. Cover 13 has its upper portion positioned immediately below the stacker assembly 15 which is shown as having created a small stack S of tickets (shown in dotted fashion) which have already undergone feeding, stripping, separating and counting.

FIG. 1*a* shows a detailed view of the front of the ticket counter 10 shown in FIG. 1 with covers 12 and 13 removed.

As shown therein, an infeed hopper 16 is comprised of a stationary plate 17 for supporting a stack S′ of tickets. The right-hand-most portion 17*a* of the infeed hopper supporting plate 17 is inclined at an angle greater than that of the adjacent surface portion 17*b* to which it is integrally joined.

Infeed hopper 16 is further comprised of a plate 9 which can be seen to support the forward edges of tickets in stack S. Plate 9 can be seen to be inclined at an angle relative to an imaginary vertical axis. The inclined orientation of the entire infeed hopper is such as to cause the forward or leading edges of at least a major portion of the tickets in stack S′ to rest against plate 9. The nature of the orientation of the feeding and separating mechanism is such that no special care need be given to the preparation of the stack before being placed in the infeed hopper. For example, there is no need to jog the stack in order to be sure that all forward edges of the sheets are exactly aligned so as to rest against plate 9.

The surface portions 17*a* and 17*b* of plate 17 are integrally joined at a knee portion 17*c* which is located a predetermined distance from plate 9 for tickets of a length greater than this distance, as they are fed in a direction shown by arrow A by the feeding apparatus to be more fully described. A few bottom-most sheets are displaced in the direction shown by arrow A so that their trailing edges are moved downwardly along inclined portion 17*a* causing a substantial portion of the weight of the stack to be removed from these few documents so as to facilitate stacking.

A feed belt 18 cooperates with infeed hopper support plate 17 and serves as a portion of the infeed hopper, as will be more fully described.

Closed loop feed belt 18 is entrained about a large diameter idler drum 19 mounted upon shaft 19*a* and is further entrained about drive roller 21 and idler roller 20 free-wheelingly rotatable about its shaft 20*a*. Shaft 21*a* drives roller 21. Idler roller 20 and feed drum 19 defines a linear path along which feed belt 18 moves and which linear path is substantially aligned with lower section 17*b* of support plate 17. Idler 20 is actually an eccentric idler with the opening receiving shaft 20*a* being significantly removed from the center of the eccentric roller so as to cause feed belt 18 to be moved upwardly and downwardly by eccentric idler 20 between the dotted line position 18′ and the solid line position 18. This movement performs a jogging or jostling action upon the stack of documents causing tickets to be jogged upwardly periodically which serves to "loosen" the stack and thereby greatly facilitate document feeding. A U-shaped guide plate 22 serves to restrain movement of the feed belt in a direction toward or away from face plate 11*a*.

The lower edge of plate 9 is provided with two bent portions 9*a* and 9*b* which cooperate with the portion of the feed belt extending between eccentric idler 20 and feed drum 19 to define a narrow throat portion or opening through which documents pass.

Feed drum 19 is driven by drive roller 21 in a manner described so as to constantly rotate in the counterclockwise direction as shown by arrow B to move documents in the forward feed direction as shown by arrow A.

The feed belt 18 lies beneath the path of movement of tickets while a stripper roller 23 lies above the path of movement of tickets and is locked to a shaft 24 which causes stripper roller 23 to rotate in a counterclockwise direction shown by arrow C. Roller 23 is formed of a material having a substantially high durometer to frictionally engage documents passing therebeneath. Feed belt 18 is formed from a high friction urethane material having a lower durometer than stripper roller 23. The arrangement is such that if a single document passes between belt 18 and stripper roller 23, the frictional engagement between feed belt 18 and a single ticket passing therebeneath is greater than the frictional engagement exerted upon this single ticket by stripper roller 23, so as to cause the single document to be fed in the forward feed direction.

However, if two or more documents pass between feed belt 18 and stripper roller 23, the frictional force exerted upon the upper ticket by stripper roller 23 is greater than the frictional force between engaging double-fed documents causing the documents engaged by stripper roller 23 to be driven in the rearward direction. The frictional forces exerted upon the lower double-fed document by feed belt 18 is likewise greater than the frictional engagement between the two tickets to cause the lower document to be fed in the forward feed direction, thereby assuring that the documents will be fed one at a time between feed belt 18 and stripper roller 23.

In order to cause documents passing stripper roller 23 to move along the path defined by feed belt 18, there is provided a first pair of O-ring belts 25 and 26 (see FIG. 1*b*) and a second pair of O-ring belts 30 and 31 entrained about the idler roller 27, 28 and 29 which, in turn, are free-wheelingly mounted about the conveyor O-ring idler shafts 27*a*, 28*a* and 29*a*. O-ring belts 25 and 26 can be seen to be arranged in spaced parallel fashion and are entrained about idlers 28 and 29. O-ring belts 30 and 31 are more closely spaced than belts 25 and 26 and can be seen to be entrained about idlers 27 and 28. The O-ring belts 25 and 26 bear against the belt 18 entrained about idler drum 19 so as to hold belts 25 and 26 in a curved configuration between idlers 29 and 28 in the region where the feed belt loops about feed drum 19.

A portion of the O-ring belts 30 and 31 bear against feed belt 18 where it loops about feed drum 19 so as to impart a curved configuration thereto. The remaining portions of belts 30 and 31 extending between feed drum 19 and idler 27 forms a substantially straight line path P. Thus, it can be seen that documents passing in single file beyond stripper roller 23 are caused to move around a substantially U-shaped path defined by feed drum 19 thereby executing a substantially 180° turn after which the ticket arranged in single file pass along a linear path P extending over substantially the major length of feed belts 30 and 31 extending between feed drum 19 and idler roller 27.

As documents pass beneath stripper roller 23, their relative stiffness has a tendency to cause the tickets to want to move along a straight line path. In order to deflect and guide the leading edges of tickets along the curved path, a deflector plate 32 is provided. Guide plate deflector 32 is mounted to face plate 11*a* by fastening means 32*d* and a spacer 32*e* as shown best in FIG. 1*b*. The lower edge 32*a* of plate 32 has a curved surface to guide the leading edges of tickets downwardly so that they pass between O-ring belts 25 and 26 and feed belt 18. As can best be seen from FIGS. 1*a* and 1*b*, stripper roller 23 is provided with a central groove 23*a* and plate 32 extends partially into the groove as shown by dotted portion 32*b*.

Figures 1B, 1C, 2A, 2B, 3A, 3B, 4A, 4B:
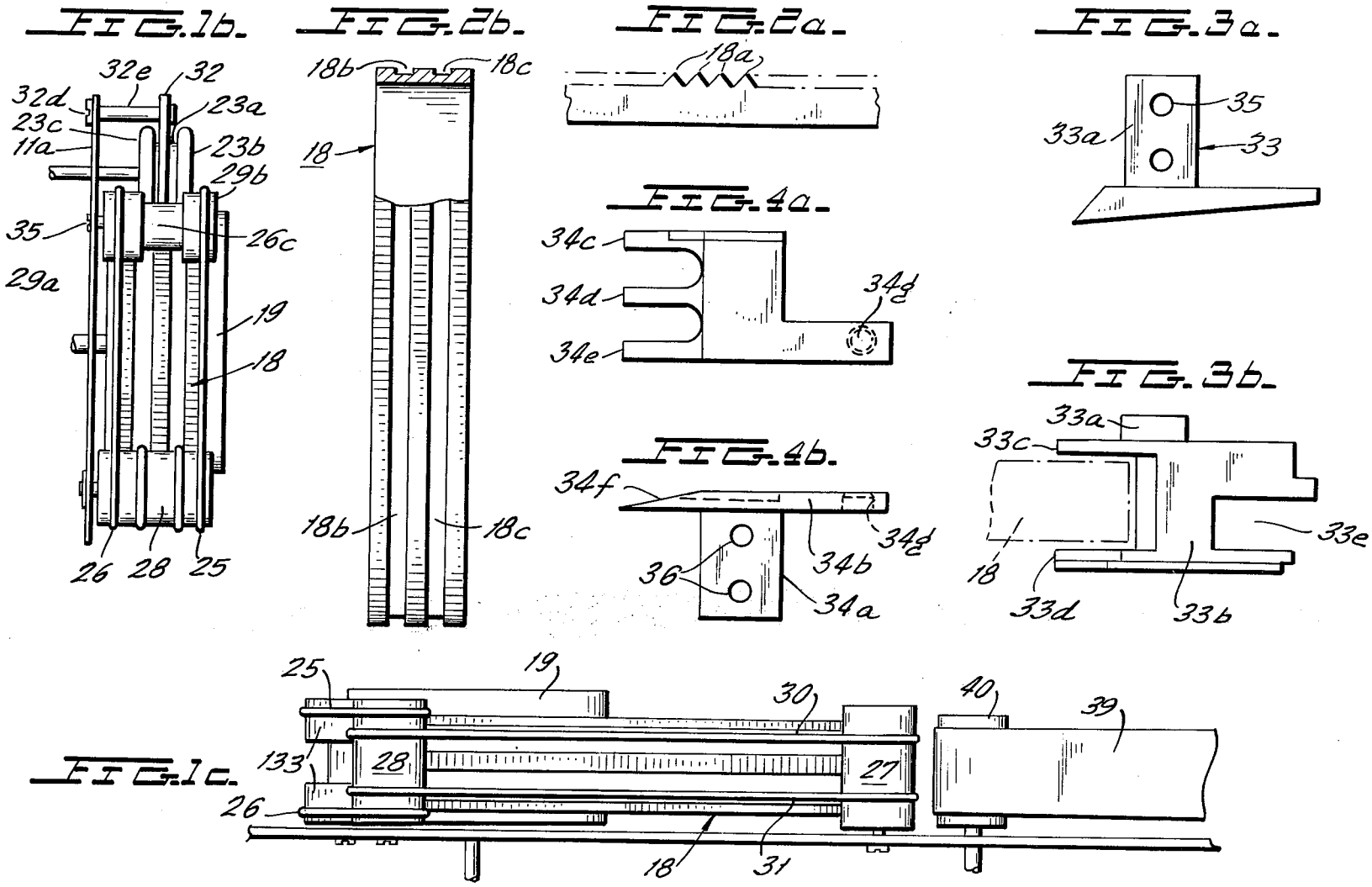
FIG. 1*b* shows an end view of the feed assembly of FIG. 1*a*.
FIG. 1*c* shows a bottom view of the feed assembly of FIG. 1*a*.
FIGS. 2*a* and 2*b* show profile and partially sectionalized use of the feed belt of FIG. 1.
FIGS. 3*a* and 3*b* show elevational and top views of the upper guide plate of FIG. 1*a*.
FIGS. 4*a* and 4*b* show top and elevational views of the lower guide plate of FIG. 1*a*.

Similarly, O-ring idler 29 can best be seen from FIG. 1*b*, to be comprised of two roller portions 29*a* and 29*b* with a spacer 26*c* provided therebetween. A shaft free wheelingly mounted assembly 29 is secured to front plate 11*a* by fastening means 35. A dotted line portion 32*c* of deflected guide plate 32 extends into the grooved region defined by spacer 26*c* and roller portions 29*a* and 29*b*, as shown in FIG. 1*a*. This arrangement assures that the leading edge of documents will be appropriately guided between O-ring belts 25 and 26 and feed belt 18.

As was mentioned hereinabove, feed belt 18 is formed of a high friction urethane material and, in one preferred embodiment has a durometer of 60, shore A. The feed belt is provided with triangular teeth 18*a* as shown best in FIG. 2*a* which are approximately 25 mils high and number approximately 15 teeth per inch.

The feed belt has two continuous grooves 18*b* and 18*c* as shown best in FIG. 2*b* which has been partially sectionalized. These grooves are preferably 50 mils deep and have a width of the order of 150 mils. The grooves cooperate with the two portions 23*b* and 23*c* of stripper roller 23 to cause the tickets to assume an undulating or corrugated configuration as they pass between feed belt 18 and stripper roller 23, which corrugated configuration serves to stiffen the documents thereby greatly facilitating the feeding and stripping operation. The triangular teeth in belt 18 have been found to greatly extend the document thickness range which can be accommodated. For example, document thickness over the range from 2–15 mils, with a common setting of stripper roll 23, have been found to feed satisfactorily through the device. The triangular teeth have also been found to improve the overall feed reliability.

As documents pass along the curved path defined by a portion of feed belt 18 entrained about feed drum 19 and the O-ring belts 25 and 26, they enter into the region between a portion of the idler belt extending between feed drum 19 and drive roller 21 and the O-ring belts 30 and 31, which path is substantially a straight line path P.

The shafts 29*a* and 28*a* which free wheelingly mount O-ring belt idlers 29 and 28 firmly press the tickets against the belt 18. However, the relative positions between shafts 21*a* and 27*a* which support drive wheel 21 and idler 27, are spaced a sufficient distance apart so as to substantially loosely hold documents in the straight line path portion P for a reason to be more fully described.

As the leading edge of each ticket passes to the right of rollers 21 and 27, they enter between upper and lower document guides 33 and 34. Upper document guide 33 is a substantially L-shaped member having a mounting bracket portion 33*a* with an opening provided to receive fastener 35 to secure the upper guide to front face-plate 11*a*. The FIGS. 3*a* and 3*b* show the upper document guide in greater detail wherein mounting portion 33*a* is secured to the guide portion 33*b* which has a pair of bifurcated arms 33*c* and 33*d* which straddle the feed belt 18 (as shown in dotted line fashion in FIG. 3*b*) so as to prevent documents from leaving the feed path.

The lower document guide 34 (note alo FIGS. 4*a* and 4*b*) has a mounting portion 34*a* for receiving a pair of fasteners 36 to secure the guide to front plate 11*a*. The guide portion 34*b* is provided with three teeth 34*c*, 34*d* and 34*e* arranged in spaced parallel fashion and having bevelled upper surfaces as shown at 34*f*. The spacing between teeth 34*c*, 34*d* and 34*e* enables the guide to straddle between the O-ring belts 30 and 31. This serves in a manner similar to the upper guide 33 to prevent documents from leaving the designated feed path.

Upper guide portion 33*b* (note especially FIG. 3*b*) is provided with a slot 33*e* to provide clearance for a "light pipe" 37 whose function will be more fully described. An opening 34*g* in lower guide portion 34*b* is provided to mount a light source 38 which together with light pipe 37 and other components to be more fully described, forms a gap detector which functions as a ticket counter.

As the forward edges of tickets pass between guides 33 and 34, they enter into a nip defined by a flat closed loop belt 39 entrained about an acceleration pulley 40 fixed to rotatable shaft 40*a*, and an acceleration idler 41 mounted upon acceleration idler shaft 41*a* which is spring loaded by spring means S having an upper end hooked about shaft 41*a* and having a lower end secured to the interior surface of face plate 11*a* at F.

Acceleration pulley 40 is continuously rotated by the single drive motor to be more fully described to impart movement to flate belt 39 which is further entrained about idlers 42 and 43 free wheelingly mounted upon shafts 42*a* and 43*a* respectively.

Pulley 40 is rotated at an angular speed sufficient to abruptly accelerate tickets as their leading edges pass between the nip formed by belt 39 and acceleration idler roller 41 so as to increase the velocity of tickets to a speed as the tickets move along the linear path P. This causes a gap to be formed between the trailing edge of a document passing between belt 39 and idler roller 41 and the leading edge of the next document moving along the straight line path P. This gap permits counting of the documents in the following manner:

As the trailing edge of an accelerated document passes to the right of light source 38 and light pipe 37, due to its increased velocity, a gap will be formed between the trailing edge of that document and the leading edge of the next document. This permits light to pass from light source 38 to light pipe 37 which transfers the light along the light pipe to a photo-detector device (not shown) for generating a pulse indicating the presence of a gap. A satisfactory photo-detector circuit is set forth in detail in copending application Ser. No. 273,999 filed July 21, 1972 now U.S. Pat. No. 3,870,868, issued Mar. 11, 1975, and assigned to the assignee of the present invention. The pulses generated as a result of detection of a gap are applied to counter means such as, for example, counter means 44 which is incremented by a count of one each time a gap is detected in order to count the number of tickets.

It can be seen that idler roller 42 forms a "knee" or bend in belt 39 which move upwardly and to the right between pulley 40 and idler 42 and then abruptly changes its direction to move generally downward and to the right. The belt 39, in addition to acting as means for accelerating tickets, further serves as the "floor" of a stacker assembly 45 comprised of a movable stacker guide plate 46 and a stationary stacker hopper plate 47.

Figure 5D:
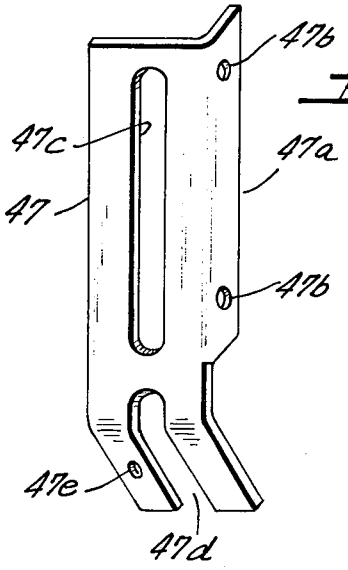
FIG. 5*d* shows a perspective view of the stacker of stationery hopper plate of FIG. 1.

Guide plate 46 is secured to a plate upper guide block 48 which cooperates with the lower guide block 49 to slidably position stacker guide plate 46 along a stacker slide member 50. Slide member 50 is shown best in FIGS. 5*a* and 5*b* and is an elongated member having a pair of grooves 50*a* and 50*b* extending along its entire length. A small guide member 51 is secured to the left-hand edge thereof and is provided with a portion 51*a* resting upon the surface of stacker slide 50 and a bent portion 51*b*. The portion 51*a* receives a fastener 52 which extends through slide 50 and solid block 53 having one tapped aperture for receiving fastening means 52 and having a tapped aperture on its inner surface for receiving a fastening member which extends outwardly from the inner surface of face plate 11*a* and through the opening in face plate 11*a* and into a tapped aperture (not shown for purposes of simplicity) in solid block 53. A similar solid block 55 is provided at the right-hand end of stacker slide member 50 and has a first tapped opening for receiving a threaded fastener 56 to secure slide 50 to block 55. Another tapped opening in block 55 receives a threaded fastener (not shown) extending from the inner surface of face plate 11*a* through the face plate into the tapped opening of block 55 whereby blocks 53 and 55 serve to position and secure slide 50 to face plate 11*a*.

Figure 5C:
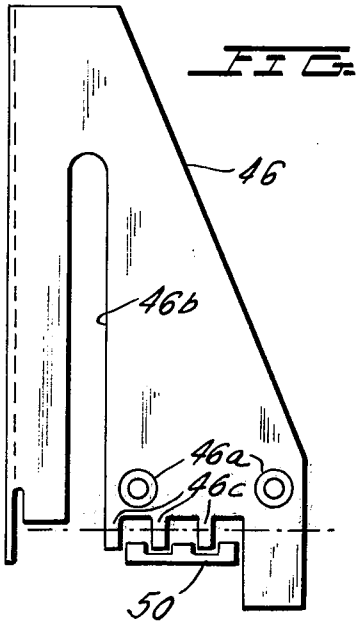
FIG. 5*c* shows an elevational view of the stacker movable guide plate and slide as shown in FIG. 1*a*.
Figure 5B:
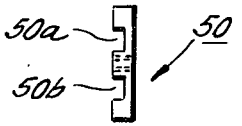
FIGS. 5*a* and 5*b* show top and end views respectively of the stacker slide of FIG. 1*a*.
Figure 5A:
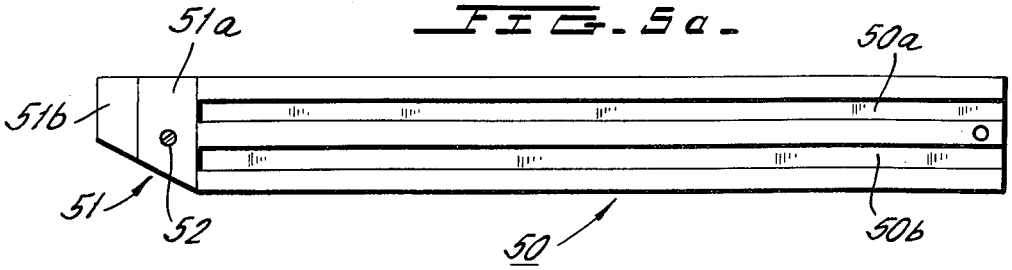

Stacker guide plate 46 is shown in detail in FIG. 5*c* and is provided with openings 46*a* for receiving threaded fasteners to secure the plate to upper guide block 48. Upper and lower guide blocks 48 and 49 are secured to one another and embrace stacker slide member 50 therebetween. A reciprocally movable latch 58 slidably extends through an opening in lower guide block 49. By gripping the downwardly extending flange 58*a* of latch 58 and moving it in the direction shown by arrow 62, a frictional force exerted upon slide 50 by latch 58 is released, enabling the stacker guide plate to be moved either generally toward the left or toward the right to accommodate the stacking of documents of varying lengths. Once guide plate 46 is appropriately positioned, the latch member may be released and a spring (not shown) returns the latch in the direction shown by arrow 61 to lock the guide plate assembly into position in readiness for a stacking operation. Plate 46 is inclined at an angle of less than 90° relative to face plate 11*a* to deflect documents toward face plate 11*a* and thus assure proper stacking of the documents.

Considering FIG. 5*c*, it can be seen that plate 46 is provided with an elongated substantially vertically aligned slot 46*b* which provides sufficient clearance for the right-hand end of stacker arm 63 to be more fully described in cases where the stacker guide plate is positioned sufficiently close to stationary hopper plate 47 to cause the right-hand end of stacker arm 63 to extend through slot 46*b*.

The bottom edge of stacker guide plate 46 is provided with a plurality of teeth 46*c* which extend into the grooves 50*a* and 50*b* of stacker slide 50 to prevent tickets from passing between guide plate 46 and slide 50. This can best be appreciated from FIG. 5*c* in which dotted line T represents the bottom-most ticket in a stack which rests upon the upper surface of stacker slide 50. Since teeth 46*c* extend below this level, the tickets will not pass therethrough and will be neatly stacked.

FIG. 5*d* shows a perspective view of hopper plate 47 which is comprised of an arm portion 47*a* having openings 47*b* for securing the plate to face plate 11*a*. An elongated slot 47*c* provides sufficient clearance for stacker arm 63, to be more fully described. A lower slot 47*d* provides clearance for the acceleration idler roller 41 while opening 47*e* serves as a means for passing the lower end of light pipe 37 and securing its lower end in proper position, as can best be seen in FIG. 1*a*.

Tickets moving under the influence of accelerator pulley 40 and its cooperating idler 41, move in the direction shown by arrow 66. Stacker arm 63 causes the leading edge of each ticket entering the stacker to be guided from movement in the direction shown by arrow 66 toward movement in the direction shown by arrow 67. The stacker arm 63 further causes the trailing edge of each ticket to "flip up" so as to be substantially in spaced parallel alignment with stacker slide guide 50 immediately after clearing the acceleration pressure roll 41 and the stacker hopper plate 47. This action clears the way for the leading edge of the next succeeding ticket to be driven under the preceding ticket to form a neat stack. Each ticket raises the stack by a height equal to its own thickness, pushing the stack upwardly and away from the stacker slide guide 50 and flat belt 39.

A means must be provided to cause the very first ticket entering the stacker to follow a curved path around the flat belt pulley idler 42 and hold the document parallel with the stacker guide plate 50 and stacker belt 39. This means must exert sufficient weight to prevent the leading edge of the second document from turning the first document up on end and hold the incoming document against flat belt 39 until its leading edge abuts adjustable stacker guide plate 46.

As soon as a stack of documents having a height of the order of ¼ to ½ inch is accumulated in the stacker hopper 45, the stacker arm weight is no longer required since the weight of the documents is sufficient to assure proper stacking of any subsequent documents. As the weight of the stack increases, the added weight of the stacker arm would cause excess wearing of flat belt 39. The desired action thereby requires a stacker arm to initially exert a weight approximately equal to a stack of tickets having a height in the range from ¼ to ½ inch with the weight of the stacker arm upon the stack decreasing sharply after a sufficient number of documents have been stacked in hopper 45.

Figure 6C:
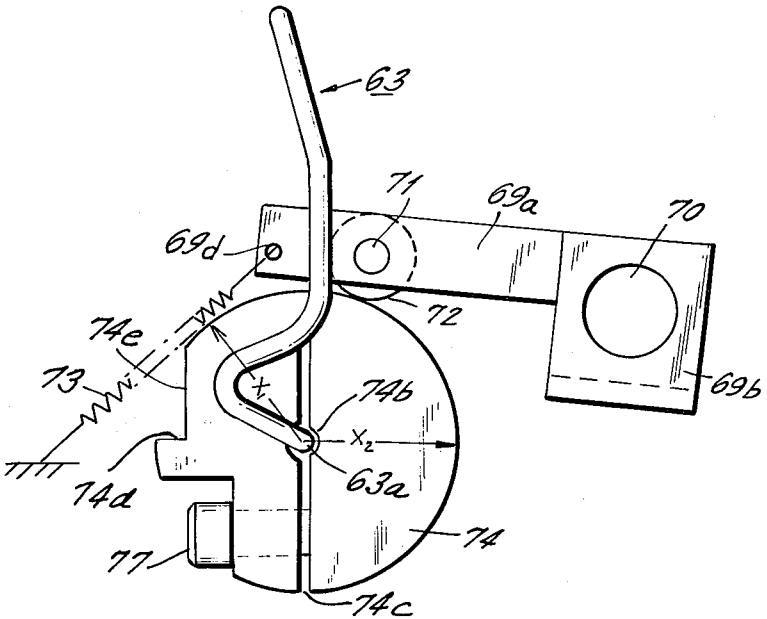
FIGS. 6*a* and 6*c* show elevational views of the stacker arm assembly of FIG. 1*a*.
Figure 6A:
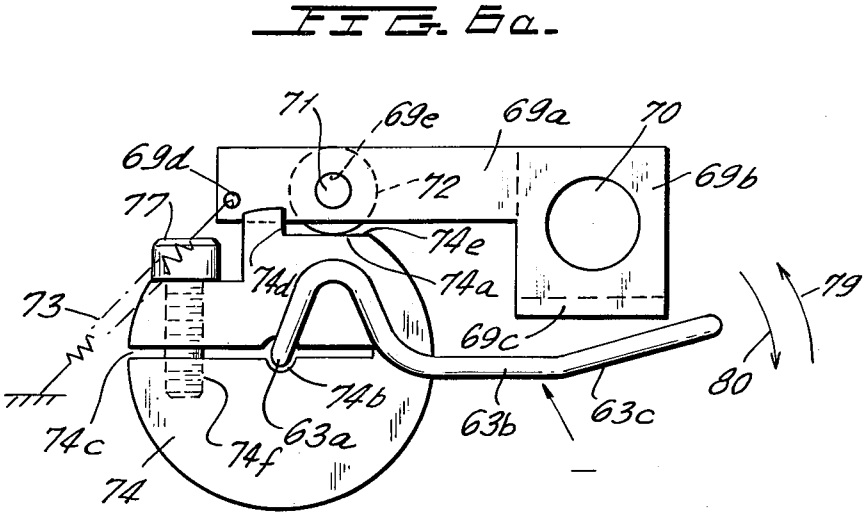
Figure 6B:
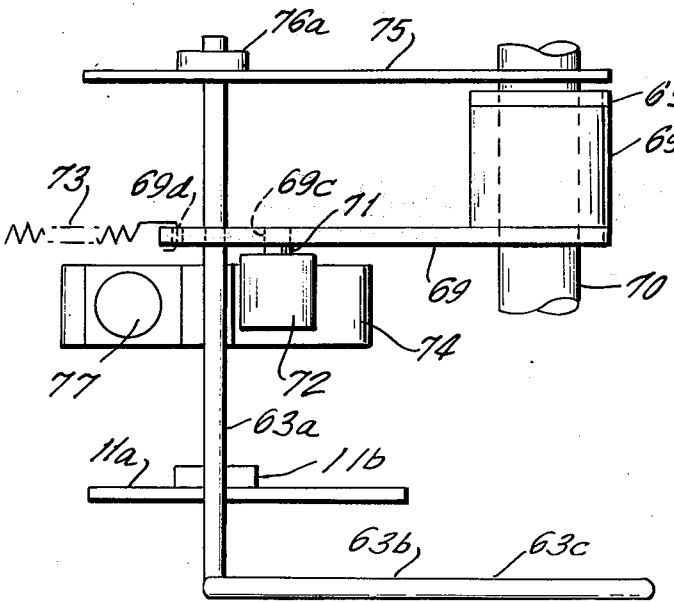
FIG. 6*b* shows a top view of the stacker arm assembly of FIG. 6*a*.

All of these functions are accomplished with the spring loaded cam follower and notched cam employed in conjunction with the stacker arm, said structure being shown best in FIGS. 6*a* – 6*c*. As shown therein the stacker arm has an intermediate portion 63*b* extending between straight portion 63*a* which serves as the stacker arm shaft, and free end 63*c*. With the stacker arm in its initial position as shown best in FIG. 1*a*, free end portion 63*c* can be seen to lie substantially parallel to and upon the upper run of belt 39 extending between idlers 42 and 43. Intermediate portion 63*b*, together with the run of flat belt 39 extending between rollers 40 and 42, defines a tapering infeed region which provides sufficient clearance for documents to enter into the stacker hopper 45. The shaft arm portion 63*a* of stacker arm 63 is rotatably supported by front face plate 11*a* and rear space plate 75 shown best in FIG. 6*b*, bearings 76*a* and 11*b* being provided at plates 75 and 11*a* respectively for free-wheelingly mounting shaft portion 63*a*.

Eccentric cam 74 is secured to stacker arm shaft portion 63*a* by means of a central opening 74*b* which lies intermediate the ends of an elongated slot 74*c*. Shaft portion 63*a* is extended through opening 74*b* fastening member 77 and threadedly engages a tapped opening 74*f* provided in cam 74 to draw the cam portions above and below slot 74*c* toward one another in order to secure cam 74 to shaft portion 63*a* so that any rotation imparted to shaft portion 63*a* will cause rotation of cam 74.

Cam 74 is provided with a notch 74*a* having a shoulder 74*d*. Notch 74*a* and shoulder 74*d* cooperate to seat a roller 72 freewheelingly mounted by a pivot pin 71 to cam follower 69. Cam follower 69 has a U-shaped mounting portion comprised of short arm 69*b* and long follower arm 69*a* joined to one another by a yoke portion 69*c*. Openings are provided in these arms for receiving a stationary shaft 70 to permit pivotal movement of the cam follower arm about shaft 70. An opening 69*d* is provided at the free end of arm 69*a* to receive one hooked end of a helical biasing spring 73 whose opposite end is secured to the frame of the counter. Opening 69*e* in arm 69*a* is provided for receiving the pin 71 which free-wheelingly mounts roller 72.

FIG. 6*a* substantially shows the position of the cam follower arm when the stacker hopper 45 is empty. In this position the free end 63*c* is positioned immediately above the run of belt 39 between roller 42 and backplate 46 as can best be seen in FIG. 1*a* so as to provide a small clearance therebetween. Spring 73 biases the cam follower arm 69*a* in a counterclockwise direction as shown by arrow 79 in FIG. 6*a*.

As the first document enters between the tapered infeed region defined by the intermediate portions 63*b* of arm 63 and the run of flat belt 39 between rollers 40 and 42, the leading edge of a document bears against the underside of arm portion 63*b* and is guided downwardly so as to move beneath the free end portion 63*c* and be driven against adjustable back plate 46 by the action of belt 39. The force required to raise the cam follower roller 72 out of notch 74*a* and over knee 74*e* and the distance the arm is raised before most of the force is removed is determined by the depth and shape of notch 74*a*. Opening 74*b* is arranged to lie off center so as to make cam 74 eccentric, which eccentricity compensates for the weight of the stacker arm to assure that the arm 63 returns to its original position when documents are removed from the stacker. The eccentricity of cam 74 can best be appreciated from a consideration of FIG. 6*c* wherein the radial distance $X_1$ is less than the radial distance $X_2$. The cam and cam follower arrangement operates in the following manner:

Before any documents are loaded into the stacker hopper 45, the stacker arm is in the position shown in FIG. 6*a* (Note also FIG. 1*a*). As the first group of documents are fed into the stacker hopper 45, the weight of the first few documents is clearly insufficient to independently assure the formation of a neat stack. Thus the maximum force exerted by stacker arm 63 upon incoming documents exists when roller 72 rests upon surface 74*a* and before roller 72 rolls beyond knee 74*e*. As soon as a sufficient number of documents have been stacked in hopper 45, cam 74 will rotate counter clockwise in the direction shown by arrow 79 (see FIG. 6*a*) to urge follower arm 69*a* clockwise about shaft 70 and against the biasing force of spring 73. Once the roller moves past knee 74*e*, the force exerted by follower arm 69*a* upon cam 74 is somewhat reduced. Just prior to this movement, it can be seen that the stacker arm is most affected by gravity at this time. As the stacker arm rotates in the counter clockwise direction shown by arrow 79 and from the position of FIG. 6*a* toward the position shown in FIG. 6*c*, the follower arm 69 gradually moves further away from the center of cam 74 due to the gradually increased radius of cam 74 which increases from a radius value $X_1$ toward a larger radius value $X_2$. This movement increases the expansion of biasing spring 73 to an extent sufficient to assure the cam 74 and stacker arm 63 will automatically be moved toward the position shown in FIG. 6*a* when a stack of documents is removed from the hopper. The reason for this eccentricity is that the stacker arm 63 is substantially vertically aligned as shown in FIG. 6*c* and the eccentricity of cam 74 insures the return of stacker arm to the position in FIG. 1*a* without exerting too much weight upon the documents in the stacker so as to prevent undue wearing of the stacker feed belt 39.

The rod-like shape of stacker arm 63 also serves to reduce the amount of weight exerted by the stacker arm upon the stack of documents being formed.

Figure 7B:
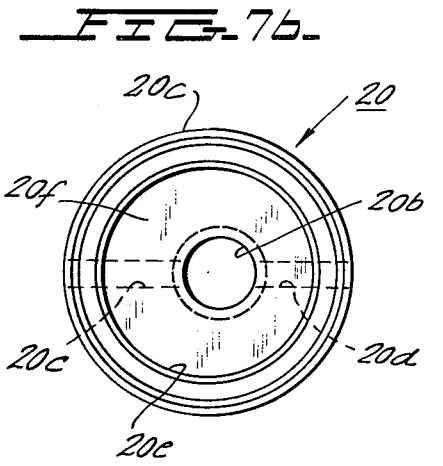

As was described herein above, the counter of the present invention is designed to provide a capability of feeding, separating, counting and stacking documents which may be of varying widths, for example over the range from 1 to 2 inches wide or wider. In order to facilitate the stacking of wider documents, the eccentric idler 20 shown in FIG. 1*a* may be fitted with a hub extension as shown best in FIGS. 7*a* and 7*b*. Eccentric idler 20 is comprised of a metallic body having a central opening 20*b* for mounting of the eccentric idler upon shaft 20*a*. A tapped opening 20*c* is provided for receiving a set screw (not shown for purposes of simplicity) for locking the eccentric idler 20 to shaft 20*a*. The peripheral surface of the body is provided with a crowned surface 20*c* which can best be seen from FIG. 7*a* as having a curvature in the direction of center line C. The eccentricity of the central opening 20*b* can best be seen in FIG. 7*b*.

Figure 7A:
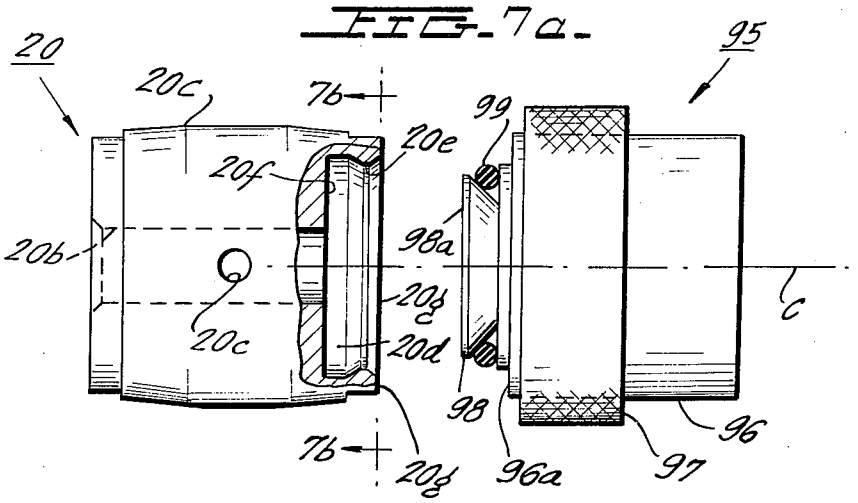

Considering FIG. 7*a*, the right-hand end of eccentric idler 20 is provided with an opening 20*d* terminating at flat base 20*f* and a sidewall with tapers inwardly from the right-hand edge 20*g* surrounding the opening toward 20*e* and which then tapers radially outward again toward the flat base 20*f* of the opening.

An extension hub 95 is provided for releaseable mounting to extension 20. This hub 95 is comprised of a cylindrical shaped rigid body portion 96 having a band 97 of a high friction material completely encircling the lefthand portion of metallic body 96. The lefthand end of metallic body 96 has an outwardly flared projection which is designed to seat an O-ring 99 within a circumferential groove formed by projection 98, the O-ring 99 being shown in sectional fashion. The hub extension 95 may be pressed into opening 20*d* in eccentric pulley 20 causing the O-ring 99 to be squeezed inwardly as it passes the inwardly tapered portion 20*e* surrounding opening 20*d*. As soon as the left-hand surface 96*a* abuts the right-hand surface 20*g* surrounding opening 20*d*, O-ring 99 expands providing a good frictional fitting of the hub extension within eccentric pulley 20. In this manner, the frictional band 97 of picker extension wheel 95 cooperates with the feed belt 18 to provide a greater frictional surface area for feeding tickets of greater width into the nip formed by the portion of the feed belt 18 entrained about feed drum 19 and the stripper roller 23.

Figure 8B:
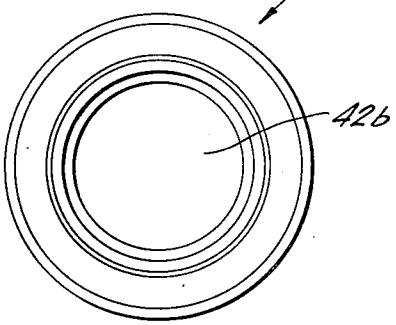
FIG. 8*b* shows and end view of the stacker pulley of FIG. 8*a*.
Figure 8A:
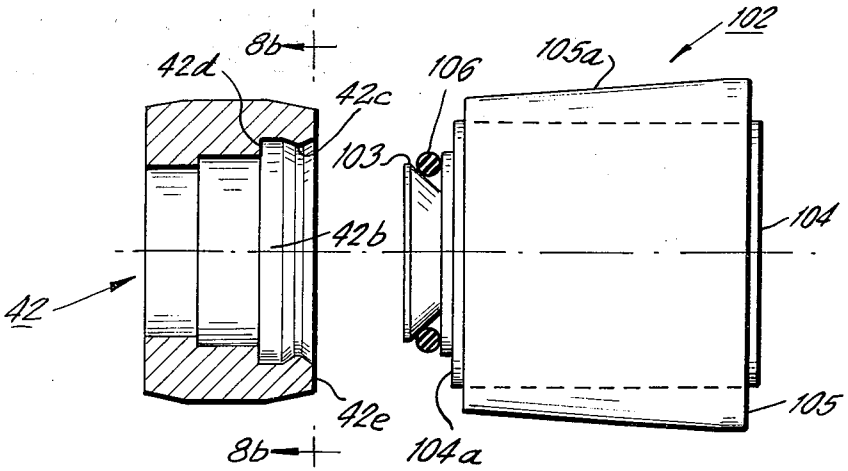
FIG. 8*a* shows a side view, partially sectionalized of the stacker pulley and stacker pulley extension of FIG. 1*a*.

In a similar fashion, the idler pulley 42, shown in greater detail in FIGS. 8*a* and 8*b*, is provided with a similar opening 42*b* having a tapered portion 42*c* of narrow diameter and which is adapted to receive the flared projection 103 provided on metallic core 104 of the stacker extension member 102. A circumferential band 105 of high friction material having a flared or tapered peripheral surface 105*a* is mounted upon metallic core 104. An O-ring 106 shown in sectional fashion in FIG. 8*a* is seated in a groove defined by flared projection 103 and is similarly caused to contract when the extension is pressed into opening 42*b* until the left-hand surface 104*a* of core 104 abuts against the right-hand surface 42*e* surrounding opening 42*b* in idler pulley 42, at which time the O-ring 106 is free to expand providing a good friction fit of the extension 102 within pulley 42. As will be best noted from FIG. 8*a*, the flared peripheral surface 105*a* of high friction material cooperates with the flat feed belt 39 to drive tickets into the stacker hopper 45. The tapered circumferential surface 105*a* serves to drive the tickets toward face plate 11*a* so as to neatly stack tickets within the hopper.

As shown best in FIGS. 1*a* and 9, plate 9 is provided with a pair of notches 9*c* and 9*d* which collectively define a finger 9*e* whose free end extends within the circumferential groove 23*a* in stripper wheel 23 so as to prevent the leading edge of tickets from being jammed between the lower edge of plate 9 and stripper wheel 23. This arrangement also keeps the counter-rotation of the stripper wheel from curling the leading edge of a mutilated document.

FIG. 10*a* and 10*b* show the stripper arm assembly which floatingly mounts stripper wheel 23. This assembly is comprised of a stripper pivot arm 115 having a first pair of bifurcated arms 116 and a second pair of bifurcated arms 117. Arms 117 are provided with openings for receiving a shaft 118, one end of which is secured to front face plate 11*a* and the other end to the back mounting plate 75 (see also FIGS. 6*b* and 13). A pair of collars 119 serves to restrain stripper pivot arm 115 from experiencing any linear movement relative to shaft 118.

The other pair of bifurcated arms 116 have a shaft 121 passing through openings provided therein. The left-hand end of this shaft (relative to FIG. 10*a*) is secured to a collar 122 forming part of a large diameter pulley 123 driven by a closed loop O-ring 124 (shown in sectional fashion in FIG. 10*a*). This belt is also entrained about a pulley operated by the motor drive in a manner to be more fully described. Shaft 121 extends through an opening or slot 75*c* in back plate 75 to provide sufficient clearance for pivotal movement of shaft 121 received by stripper pivot arms 117. A pair of collars 126 restrains movement of pivot arm 116 in the linear direction relative to shaft 121. Bearing assemblies 127 and 128 are provided in the openings in bifurcated arms 116, as are bearings 129 and 130 provided in the openings in bifurcated arms 117 to free-wheelingly mount shafts 121 and 118.

The right-hand end of shaft 121 (relative to FIG. 10*a*) extends through an arcuate shaped clearance slot in face plate 11*a* and its free end is secured to stripper roller 23. The O-ring 124 thus serves to impart rotational movement to stripper roller 23, as well as imparting a downward force of the stripper roller 23 upon feed belt 18 or alternatively upon tickets passing between stripper roller 23 and feed belt 18.

The ticket counter is provided with an endorsing or cancelling capability designed to print one or more bands of printed material on the tickets as they pass about the curved portion of the feed path defined by feed drum 19.

The endorser assembly 130 can best be seen in FIG. 1*a* and is comprised of an ink roll 131 mounted upon shaft 131*a*, an ink transfer roll 132 mounted upon shaft 132*a* and an endorser drum 133 mounted upon shaft 133*a*.

The endorser assembly is designed to be operated by lever arm 134 to enable the endorer to be moved to either the engaged position for endorement or to the disengaged position to permit counting of tickets without endorsing or cancelling.

Figure 11A:
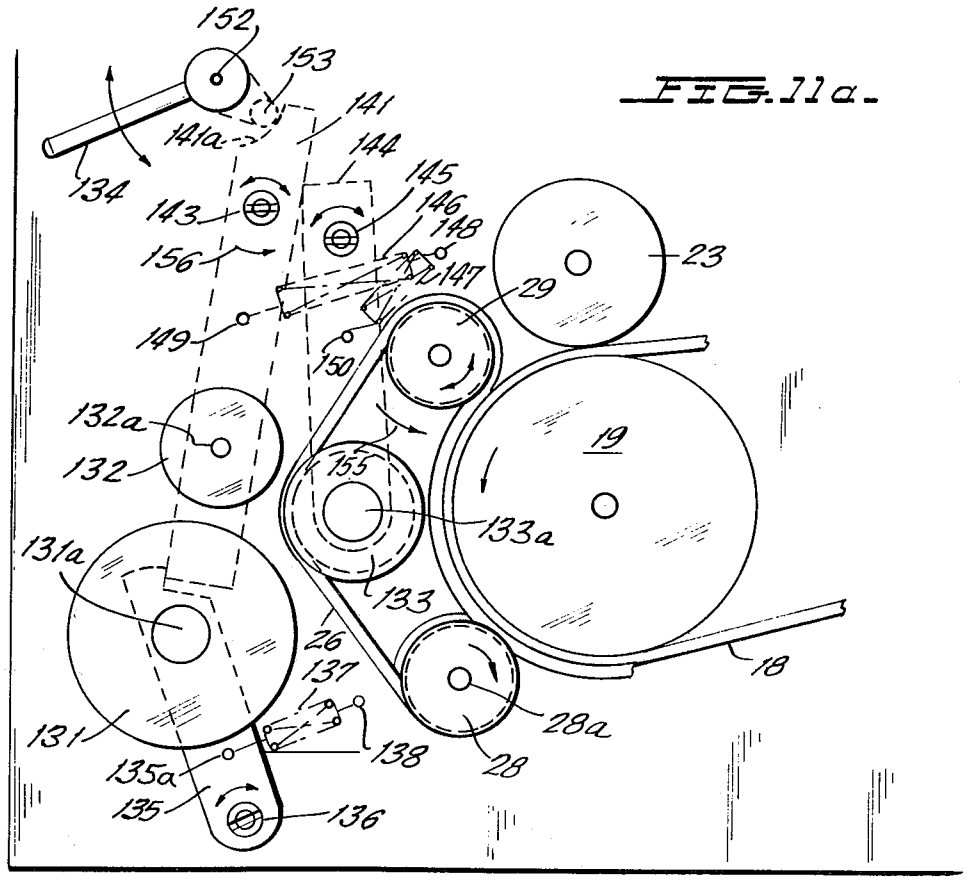
FIG. 11*a* shows the endorser assembly of FIG. 1*a* in the disengaged position.
Figure 11A:
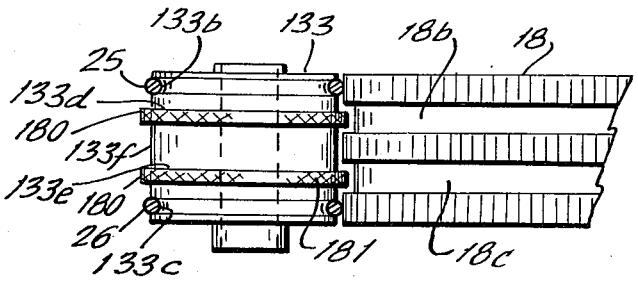
Figure 11B:
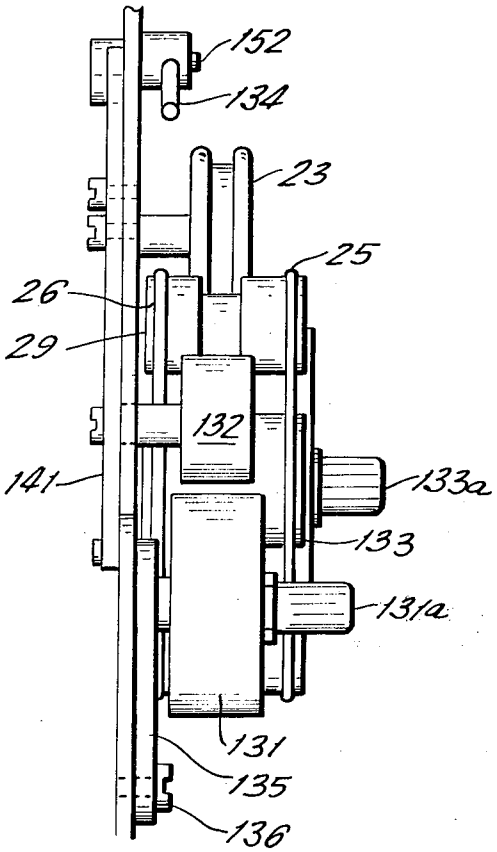
FIG. 11*b* shows an end view of the endorser assembly of FIG. 11*a*.

As shown in FIGS. 11*a* and 11*b*, which will be considered in conjunction with FIG. 1*a*, shaft 131*a*, on which ink roller 131 is mounted, is secured near one end of a lever arm 135 pivoted about a pin 136 secured to face plate 11*a* and extending into the interior of the ticket counter housing. A biasing spring 137 is secured at one end to a pin 138 secured to the interior of face plate 11*a* and has its other end secured by means of a pin 135*a* to lever 135, so as to normally urge lever 135 in the clockwise direction, as shown by arrow 139. Transfer roller 132 is mounted upon transfer roll lever 141 which is pivotally mounted to face plate 11*a* by a shaft 143. Endorser drum 133 is similarly mounted upon an endorser drum lever 144 pivotally mounted to face plate 11*a* by a pivot pin 145. Helical springs 146 and 147 (FIG. 11*a*) each have a first end thereof secured to a pin 148 mounted to face plate 11*a*. The opposite end of spring 146 is secured to lever arm 141 by a pin 149 while the opposite end of spring 147 is secured to lever arm 144 by a pin 150.

Endorser operating handle 134 is pivotally mounted to face plate 11*a* by a pin 152 and has a free-wheelingly mounting roller 153 secured thereto. With the endorser operating lever 134 in the position shown in FIG. 1*a*, and considering FIGS. 12*c*, 12*d* and 12*g*, arm 135 rotates in the direction shown by arrow 139 as a result of the biasing force exerted upon this arm by spring member 137. This causes the circumferential surface of ink roll 131 to engage ink transfer roll 132. Thus, ink embedded in the porous material of ink roll 131 is transferred to ink transfer roll 132 and, in turn, is transferred to the printed matter in the print bands of endorser die 133 to print upon the surface of a ticket as it is carried around by the feed belt 18 in passing about the feed drum 19. It should be noted that endorser die 133 is free-wheelingly mounted and is driven into rotation by the frictional engagement between feed belt 18 and the O-rings 25 and 26 (see FIG. 1*b*). Idler rollers 29 and 28 are similarly rotated by this frictional drive. Ink transfer roll 132 and ink roll 131 are also free-wheelingly mounted upon their lever arms and are rotated as a result of the pressure engagement between endorser die 133 and ink transfer roll 132 and between ink roll 131 and ink transfer roll 132.

By rotating endorser operating lever 134 in the counterclockwise direction (relative to FIG. 1*a*) about pivot point 152, roller 153 is driven against the curved portion 141*a* of lever arm 141, causing it to rotate in the clockwise direction shown by arrow 170 (FIG. 1*a*) and against the biasing force of spring 146. As the operating handle 134 is rotated, lever arm 141 experiences further rotation until it abuts against a beveled portion 144*a* of lever arm 144 at which time pivotal movement of lever arm 141 (about pivot 145) in the clockwise direction shown by arrow 170 starts to drive lever arm 144 in the clockwise direction shown by arrow 171. This causes the endorser die to move away from and hence be disengaged from either the feed belt 18 or tickets passing about the feed belt 18 so as to prevent the occurrence of any printing.

As lever arm 141 pivots still further in the clockwise direction shown by arrow 170 its bottom left-hand corner 141*b* bears against lever arm 135 causing it to be driven in the counter clockwise direction as shown by arrow 172 of FIG. 1*a*. This pivotal movement disengages ink roller 131 from ink transfer roll 132 until the endorser die 133, ink transfer roll 132, and ink roll 131 occupy the fully disengaged positions shown in FIG. 11*a*. It is thus possible to operate the ticket counter with the endorser disengaged so as to prevent endorsing or cancelling operation.

By moving the operating handle 134 from the position shown in FIG. 11*a* to the position shown in FIG. 1*a*, the endorser may be moved to the engaged position.

FIG. 11*c* shows a detailed view of the endorser die 133 in the engaged position relative to feed belt 18. As shown therein, the endorser die is provided with a pair of annular grooves 133*b* and 133*c* which serve to seat the O-rings 25 and 26 to impart rotational movement to the endorser die. The endorser die is further provided with annular grooves 133*d* and 133*e* which receive continuous bands 180 formed of either a rubber or plastic material, which bands have raised lettering 181 representative of the printed matter to be printed upon a ticket. It can be seen that band 180 extend beyond the circumferential surface 133*f* of endorser die 133 and are so positioned as to extend into the grooves 18*b* and 18*c* provided in feed belt 18 (note also FIG. 2*b*). However, it should be noted that O-ring belts 25 and 26 bear against the surface of feed drum 19 so as to prevent the print bands 180 from making rolling engagement with the basis of grooves 18*b* and 18*c*. This arrangement prevents ink from being transferred from the print bands 180 to feed belt 18 in situations where the endorser die is in the engaged (i.e., endorsing) position and no tickets are passing between the endorser die 133 and feed belt 18.

When a ticket passes between feed belt 18 and endorser die 133, the toothed surface portions serve as the support for a ticket and printing will occur on the ticket as it passes between feed belt 18 and endorser die 133.

Since it may be desired to change the printed matter to be placed upon a ticket being endorsed or cancelled, and since it is also necessary to be able to refresh the ink roll 131 at periodic intervals, it is necessary to provide a mounting for the endorser die and the ink roll which facilitates simple and yet rapid removal and replacement. For this purpose, a roll retainer assembly shown for example in FIGS. 12*a* – 12*c* is provided.

Figures 12A, 12B, 12C, 12D, 12E, 12F, 13:
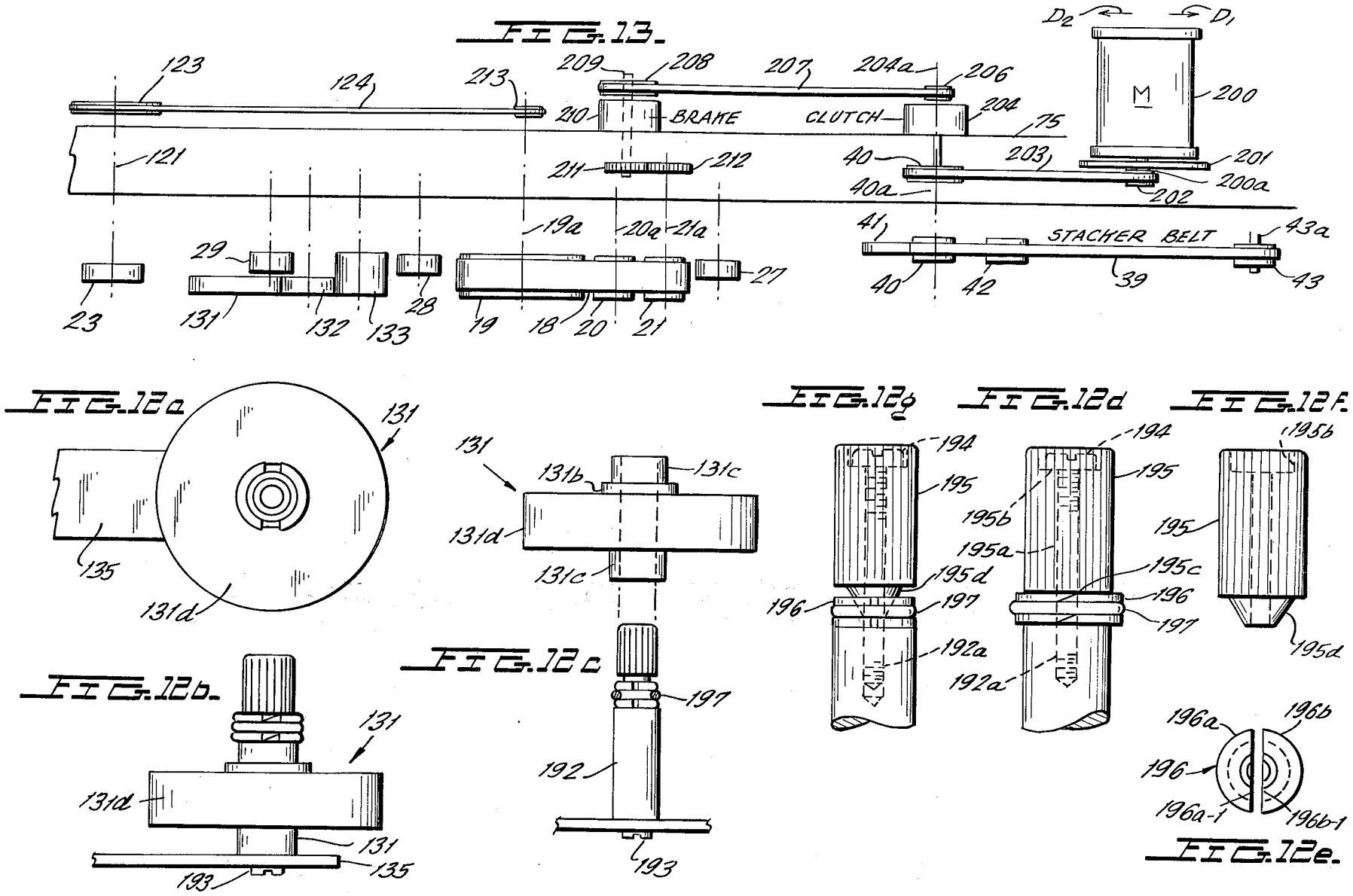

Although the arrangement of FIGS. 12*a* – 12*c* show an assembly for the ink roller, it should be understood that substantially the same assembly is provided for the endorser die and a description of the endorser die split retainer assembly will be omitted herein for purposes of simplicity.

The ink roll lever arm 135 (see FIGS. 12*b* and 11*a*, for example) has a fixed shaft 192 secured thereto by fastening means 193 (note FIG. 12*c*). The upper end of ink roll shaft 192 is tapped to received a threaded fastener 194 which extends through a clearance opening 195*a* provided in knurled nut 195. The upper end of opening 195*a* has a shoulder 195*b* upon which the head of fastening member 194 may rest. The threaded fastener 194 passes through an opening in a split retainer assembly 196 comprised of first and second split retainer members 196*a* and 196*b*. These retainer members are held together by means of a resilient O-ring 197 shown best in FIG. 12*d*. Threaded fastener 194 extends into a tapped opening 192*a* in ink roll shaft 192.

Threaded fastener 194 is firmly secured within tapped opening 192*a* so as to prevent any turning of the threaded fastener.

The bottom portion 195*c* of opening 195*a* in knurled nut 195 is threaded so as to loosely but threadedly engage threaded fastener 194. Knurled nut 195 has its bottom portion tapered as shown at 195*d*, which tapered portion extends into the opening collectively defined by split retainer halves 196*a* and 196*b*.

As shown best in FIGS. 12*a*, and 12*b* and 12*c*, ink roll 131 is provided with a hollow cylindrical member 131*c* having a bushing 131*b*. Member 131*c* is adapted to free-wheelingly rotate upon shaft 192. A porous ink roll 131*d* is fixedly secured to member 131*c* and rests against bushing 131*b*.

In order to mount ink roller 131 upon ink roller shaft 192 knurled nut 195 is rotated so as to be moved from the position shown in FIG. 12*d* to the position shown in FIG. 12*g*. This causes knurled nut 195 to be lifted or moved away from the split retainer members so that its tapered portion 195*d* moves out from between the central opening defined by retainer halves 196*a* and 196*b*. O-ring 197 is thus free to draw the split retainer members toward one another so that their flat portions 196*a*-1 and 196*b*-1 move towards engatement with one another. It can be seen from FIGS. 12*c* and 12*g* that with the split retainer members in this position, that these members collectively define a periphery having an outer diameter equal to or slightly less than the diameter of ink roll shaft 192. In this position, the ink roll 131 is brought into alignment with the knurled nut 195 and then passed downwardly until it is seated upon the shaft 192, as shown, for example, in FIG. 12*b*. After mounting of the ink roll in this manner, knurled nut 195 is rotated in the reverse direction so that it moves from the position shown in FIG. 12*g* to the position shown in FIG. 12*d*. This drives the tapered portion 195*d* of knurled nut 195 into the central opening collectively defined by split retainer halves 196*a* and 196*b*, causing the tapered portion 195*b* to act against the restraining force exerted upon the split retainer halves by O-ring 197 to move the split retainer halves apart and to the position shown in FIGS. 12*b* and 12*d*. It can be seen that when the knurled nut and split retainer halves are in the position shown in FIGS. 12*b* and 12*d* that their diameters extend over and beyond the diameter of shaft 192 (see FIG. 12*c*) so as to retain the ink roller 131 upon ink roller shaft 192. The distinct advantage of this arrangement is to provide a retainer assembly in which no parts are required to be removed in order to remove the ink roller since the threaded fastener 194 is locked in the tapped opening in shaft 192, thus assuring an arrangement in which no parts can be either mislaid or lost during an operation in which an ink roller is removed and/or replaced.

A substantially identical retainer assembly is provided for the endorser die and functions in the same manner to facilitate removal and/or replacement of the endorser die, for example, for the purpose of changing the print band, without misplacing any of the components of the retainer assembly.

FIG. 13 shows the power train for the ticket counter of the present invention, which power train is comprised of a single motor 200 secured to a pivotally mounted plate 201 to enable adjustment of the motor in either of the directions shown by arrows $D_1$ and $D_2$. The motor drive shaft 200*a* extends through an opening in the pivotally mounted plate 201 and has a pulley 202 secured thereto. A timing belt 203 is entrained about pulley 202 and a pulley 40*b* mounted upon the shaft 40*a* (see FIG. 1*a*) to which the stacker drive acceleration roller is mounted. As was described hereinabove, pulleys 42 and 43 are idler pulleys having flat belt 39 entrained therearound. Shown immediately adjacent stacker acceleration drive roller 40 is the spring mounted idler roller 41. Roller 41 is shown positioned to the left of drive roller 40 for purposes of simplicity, but in actuality, as can best be seen from FIG. 1*a*, this roller is positioned substantially above roller 40.

Also mounted to shaft 40*a* is an electromagnetic clutch 204 which is secured to back spacer plate 75 referred to earlier. Electromagnetic clutch 204 is arranged to selectively engage and/or disengage driving power to the remaining components of the counter. Shaft 40*a* serves as the input to electromagnetic clutch 204 which has an output shaft 204*a* to which pulley 206 is secured. A timing belt 207 is entrained about pulley 206 and a pulley 208 mounted upon shaft 209 which extends through electromagnetic brake 210. Electromagnetic brake 210 is operated in conjunction with electromagnetic clutch 204, whereby brake 210 is energized at the same time that clutch 204 is deenergized, causing clutch 204 to decouple power from shaft 40*a* to shaft 204*a*, and causing brake 210 to abruptly halt all of the other drive and driven pulleys.

Brake 210 is secured to back space plate 75, and shaft 209 extends through an opening in plate 75 and has a gear 211 secured to its opposite end. This gear meshes with a gear 212 secured to the same shaft 21*a* as feed drive roller 21. The purpose of the gearing arrangement is to reverse the direction of drive to drive pulley 21. Feed drum 19, eccentric picker wheel 20, and feed drive pulley 21 are shown in FIG. 13 as having feed belt 18 entrained therearound. As can best be understood from FIGS. 13 and 1*a*, roller 21 constitutes the drive roller with belt 18 serving as a means for imparting rotation to the free wheeling eccentric picker wheel 20 and feed drum 19.

Shaft 19*a*, upon which feed drum 19 is mounted, extends rearwardly through the front face plate and the back space plate 75, and has its opposite end secured to O-ring pulley 213. O-ring belt 124 (note also FIG. 10*a*) is entrained about pulley 213 and the large diameter pulley 123 also shown in FIG. 10*a* which is driven by pulley 213 to rotate shaft 121 upon which stripper roller 23 is mounted.

All of the remaining belts and pulleys are driven from the positively driven belts and pulleys described hereinabove.

As shown for example, idler roller 27 and idler roller 28 have O-ring belts 30 and 31 entrained therearound which engage feed belt 18 to drive these belts and hence the idler rollers 27 and 28 into rotation.

Idler roller 28 also has additional O-ring belts entrained therearound and entrained about endorser drum 133 and idler pulley 29. The O-ring belts 25 and 26, which are entrained about idler pulleys 28 and 29, engage feed belt 18 to rotate pulley 28 and 29.

As was described hereinabove, endorser die 133 is driven into rotation by the O-ring belts 25 and 26 which engage the opposing peripheries of feed drum 19. Ink transfer roll 132 has its circumference engaging the circumference of endorser die 133 to be driven into rotation. Inking roll 131 has its circumference engaging the circumference of ink transfer roll 132 to be driven into rotation. Obviously when the endorser operating handle 134 (see FIG. 1*a*) is moved to the position to disengage the endorser assembly, the ink transfer roll 132 and the inking roll 131 experience no rotation, and the endorser die 133, although rotated by O-rings 25 and 26, is disengaged from feed belt 18.

Briefly summarizing the operation of the ticket counter of the present invention and particularly considering FIGS. 1*a* and 13, power push button 220 is depressed to energize the power supply (not shown) and light source 38. By depressing start button 221, clutch 204 becomes engaged and brake 210 becomes disengaged. By depressing the pushbuttons 44*a* and 222*a* of electromechanical counters 44 and 222, these counters may be automatically reset to a count of zero. With the start button 221 depressed, the stacker of belt 39 and the feed belt 18 move in a continuous fashion. A stack S′ of tickets is placed in the infeed hopper. Due to the eccentric mounting of picker wheel 20, feed belt 18 is moved from the solid line position to the dotted line position 18′ to jog or jostle the stack S′ of tickets to loosen the stack while the movement of feed belt 18 picks up the bottom-most ticket in the stack S′ and feeds it through the entry throat toward the nip formed between feed belt 18 and stripper wheel 23.

The larger diameter portions of stripper roll 23 extend into the continuous grooves formed in feed belt 18 to urge the ticket passing therebetween into an undulating or corrugated pattern which serves to stiffen the ticket and greatly facilitate the feeding and stripping operation. As was mentioned hereinabove belt 124 (note especially FIGS. 10*a* and 13) in addition to imparting rotation to pulley 123, urges pulley 123 downwardly which downward movement is imparted to stripper roll 23. The frictional force exerted upon the upper surface of a ticket by stripper roll 23 is of a smaller magnitude than the frictional force exerted upon the single ticket by the feed belt 18 causing the driving force of the feed belt 18 to be the major influence upon a ticket so as to cause the ticket to pass through the aforementioned nip and have its leading edge pass beneath the curved portion 32*a* of the guide feed plate 32 which serves to guide the forward edge of the ticket along a curved path and between the O-rings 25 and 26 entrained about idler rollers 28 and 29. The leading edge of the ticket then passes between O-rings 25 – 26 and feed belt 18 and is caused to execute substantially a 180° turn whereupon the leading edge enters into the linear travel region P between feed drum 19 and driving roller 21. Typically, a ticket is moving at a velocity of the order of 76 inches per second at this time. The leading edge of the ticket passes between rollers 21 and 27 and enters between the guide plates 33 and 34 until the leading edge is engaged by flat belt 39 entrained about acceleration roller 40 and the spring mounted idler acceleration roller 41. The velocity of the stacker belt 39 is of the order of 126 inches per second which linear speed is more than 1.7 times greater than the linear speed of feed belt 18. This causes the ticket whose leading edge enters beteen stacker belt 39 and idler roller 41 to be rapidly accelerated. Since the distance between the nip formed by belt 39 and acceleration idler 41 and the nip formed between rollers 21 and 27 is less than the length of the smallest document which can be handled by the ticket counter (said length being measured in the direction of feed), the shafts 21*a* and 27*a* upon which rollers 21 and 27 are mounted are positioned so as to cause feed belt 18 and O-ring belts 30 and 31 to only loosely grip the trailing portion of the document being accelerated by the stacker belt 39 and idler roller 41 so as to enable the document to be rapidly accelerated without O-rings 30 and 31 and feed belt 18 exerting any drag upon the ticket and further so as to prevent undue wearing of O-rings 30 and 31 and feed belt 18 due to the continuous abrupt acceleration of tickets as a result of this operation. This arrangements thereby enables the acceleration roller 40 and acceleration idler 41 to be positioned relatively close to rollers 21 and 27 thereby providing a more compact counter device.

Due to the abrupt acceleration of a ticket passing between stacker belt 39 and acceleration idler roller 41, a gap is formed between this ticket and the next succeeding ticket moving toward the stacker belt and acceleration idler roller. This gap is detected by means of the light source 38 which permits light to pass through the gap, be picked up by light pipe 37 and directed to a photodetector circuitry mounted upon bracket 37*a* to develop a counting pulse to increment counter 44 and/or counter 222. As each gap is detected, these counters are incremented.

It can be seen that the document is moving at a fairly high rate of speed and its leading edge is caused to strike the underside of stacker arm portion 63*b* which serves to deflect the leading edge of the ticket generally downwardly and toward the right so as to pass beneath the free end portion 63*c* of stacker arm 63 and ultimately abut against stacker guide plate 46 where it then comes to a halt.

The "knee" formed in stacker belt 39 by the presence of roller 42 causes the trailing edge of the document just driven into the stacker to "flip-up" to provide sufficient clearance for the leading edge of the next document.

As the height of the stack increases with the insertion of each ticket into the stacker, stacker arm 63 is pivoted about its shaft portion to move from the position shown in FIG. 6*c*. The stacker arm exerts the grestest magnitude of force upon the stack as it is just being formed. As the stack increases in height the magnitude of the force or weight exerted upon the stack continues to diminish so that the collective effect of the continually reducing weight applied to the stack by stacker arm 63 and a continually increasing weight imposed upon each entering document by the forming stack remains substantially constant until the stacker arm 63 moves substantially out of the path of movement of the forming stack which will now be at a height sufficient to guide each entering ticket into the stacker to form a neat stack.

As was mentioned hereinabove, if a document strikes stacker arm 63 at a very severe angle, for example, due to the stacker guide plate being improperly set, the velocity of the ticket will be sufficient to impart a high angular velocity to stacker arm 63 causing it to strike microswitch runner 82*a* with sufficient force to trip microswitch button 82*b*. This simultaneously causes brake 210 to be energized and clutch 204 to be deenergized to prevent the passage of any more documents to the stacker, thus abruptly preventing the feeding of any documents, to limit the magnitude of the jam condition.

As is described in U.S. Pat. No. 3,870,868 referred to hereinabove, a jam detection circuit may be coupled to the photodetector circuit for providing a second jam detection capability. For example, the range of the time interval between gaps detected by the photodetector is well defined. The electronic jam detector circuit is provided with a delay circuit which will time out at a time greater than the maximum length of the time range between gaps causing the clutch to become disengaged and the brake to become engaged thereby serving as additional means for anticipating and thereby preventing jams. In addition thereto, the jam detection circuit also illuminates a "jam" lamp 224 along the control panel face to indicate to the operator the fact that a jam condition has occurred.

After a jam condition has been corrected, and in order to continue the proper count, the continue button 225 may be depressed. If, for any reason, it is desired to stop counting operations, stop button 226 may be depressed.

The ticket counter also has the capability of "batching." A toggle switch 227 has a "batch" and "normal" position. In the "normal" position counting will occur so long as documents are placed in the ticket counter. In order to perform batching, toggle switch 227 is flipped into the "batch" position. Prior thereto, however, knurled setting knobs 228*a* provided in the count select device 228 are set to form a batch of any size from as few as one document to a maximum of 999 documents. Let it be assumed that the count select is set at the value 050 for the purpose of forming batches of 50 tickets. Toggle switch 227 is flipped into the "batch" position causing the batch lamp 229 to become illuminated. A stack of tickets is fed into the infeed hopper and counted. As soon as a count of 50 is developed in counter 44 and/or counter 222, brake 210 is abruptly engaged and clutch 204 is disengaged whereby a stack of exactly 50 tickets will have been collected in stacker hopper 45. This stack, having an exact count of 50 tickets, may then be removed from the stacker, continue button 225 is depressed and the next batch of 50 tickets is formed.

In order to ensure optimal operation of the counter, the stacker latch 58 is manipulated to permit the stacker guide plate 46 to be set so that the distance between plate 46 and hopper plate 47 is slightly greater than the length of the tickets to be stacked. Once the guide plate 46 is appropriately adjusted, the latch 58 is moved in the direction shown by the arrow 61 to lock the guide plate 46 into position.

If it is desired to endorse documents when they are being counted, the endorser operating handle 134 is appropriately moved to engage ink roller 131, transfer roller 132 and endorser die 133 to endorse and/or cancel the documents.

As was described hereinabove, removal and/or replacement of the ink roller 131 and endorser die 133 may be simply and readily carried out by operating the knurled nut 195 shown, for example, in FIG. 12*d* with the split ring assembly being designed so that no parts thereof need be removed from the machine to avoid mislaying or loss of such components.

It can be seen from the foregoing description that the present invention provides a novel ticket counter for accurately counting and/or endorsing tickets or other documents of rather small dimensions and at high speeds not heretofore obtainable through conventional devices.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. Apparatus for feeding sheets arranged in a stack in a predetermined direction, which sheets are intermixed in said stack and may be of different sizes, shapes, thickness, finishes and quality of condition, said apparatus comprising an infeed hopper;

said hopper including first and second stationary plate means for supporting said stack;

said first plate means engaging the first sheet to be fed from said stack and said second plate means engaging the leading edges of at least some of the sheets in said stack, wherein the leading edges of said sheets are those edges which first pass out of said hopper when moving in said predetermined direction;

a closed loop feed belt and roller means for supporting said belt so that a portion thereof extends between the downstream end of said plate and the lower end of said second plate and is positioned beneath said stack;

means driving one of said roller means for moving said belt so that said portion moves toward the lower edge of said second plate;

the downstream end of said belt portion and the lower edge of said second plate defining an outfeed opening for said hopper;

said first plate means having a first surface portion whose downstream end lies adjacent said outfeed opening and whose upstream end is remote from said outfeed opening, and a second inclined surface portion having a downstream end joined to the upstream end of said first surface portion with the junction defining an angle of greater than 90°, and an upstream end remote from said first surface portion wherein the upstream end of said second surface portion remote from said junction lies a spaced distance from the plate of said first surface portion;

the upstream end of said first plate means second surface portion engaging the trailing edges of the sheets near the bottom of said stack as the sheets are fed through the outfeed opening whereby these sheets are relieved of the weight of the rearward end of the stack;

said second plate means having an inclined supporting surface aligned at an angle relative to an imaginary vertical line to remove a substantial portion of the weight of the stack from the forward ends of the bottom-most sheets;

said roller means including means for periodically and regularly moving said belt in a reciprocating manner toward and away from said stack to initially engage the intermediate portion of the bottom document and simultaneously jog the documents in the stack to facilitate movement of the documents for simultaneously moving the trailing edges of documents downstream along said first and second surface portions and away from the remainder of said stack so as to remove the rearward weight of said stack from said sheet engaging the first plate means to facilitate movement of said sheet through said outfeed passageway.

2. The apparatus of claim 1 wherein said advancing means is comprised of an eccentric rotating member positioned between said first and second roller and having its periphery engaged by said belt beneath said belt portion for simultaneously jogging at least the bottom portion of said stack and engaging an intermediate portion of the bottom sheet for advancing at least the bottom sheet of said stack in the feed direction.

3. The apparatus of claim 2 wherein said belt is formed of a material having a durometer adapted to provide good frictional drive for said documents.

4. The apparatus of claim 1 wherein said belt has a toothed surface for engaging said documents.

5. The apparatus of claim 1 wherein said roller means comprises a drive roller and an idler drum;

said feed belt being entrained about said drive roller and idler drum;

said belt reciprocating means comprising an eccentric roller rollingly engaging said belt between said idler drum and said drive roller and beneath said belt portion.

6. The apparatus of claim 5 further comprising a stripper roller positioned adjacent said drum;

means for rotating said belt and stripper roller in opposite directions;

said belt and stripper roller being positioned to receive documents delivered through said outfeed opening for separating said sheets and feeding the sheets, one at a time, toward a stacking location.

7. The apparatus of claim 6 further comprising second belt means and a second group of roller means extending between said drum and said drive roller and rollingly supports said second belt means for urging said second belt means towards said feed belt to follow the path defined by said feed belt between said drum and said drive roller; said feed belt and said second belt means cooperatively defining a path for guiding and moving documents therebetween.

8. The apparatus of claim 7 wherein said second group of roller means comprises first and second idler rollers respectively positioned adjacent said drum and said drive roller;

said drive roller and said second roller being positioned at the output end of said guiding path;

acceleration means positioned adjacent said guiding path output ends for abruptly accelerating each document passing through said acceleration means before the trailing edges pass beyond said feed belt and said second belt means;

said drive roller and said second roller being spaced apart by a distance to cause said feed belt and said second belt means to loosely guide documents therebetween so as not to impede acceleration of documents as they are passed through the acceleration means.

9. The apparatus of claim 8 wherein said acceleration means comprises cooperating roller means forming a nip therebetween for acclerating documents in the feed direction as they pass through said nip.

10. The apparatus of claim 9 further comprising means positioned between said acclerating means and said guiding path output end for detecting gaps formed between succeeding documents due to said acceleration means to generate a signal upon the occurrence of a gap;

means coupled to said detecting means for accumulating said signals to generate a count representative of the number of documents passing through the acceleration means.

11. The device of claim 9 further comprising a stacker assembly adjacent the acceleration means for receiving and stacking documents delivered thereto by said acceleration means.

12. The device of claim 9 wherein said stacker assembly further comprises a hopper back plate positioned downstream relative to said acceleration means;

a third group of roller means;

stacker belt means entrained about said third group of roller means and having a portion thereof extending between said acceleration means and said plate;

means for moving said belt to convey documents delivered thereto toward said plate.

13. The device of claim 12 wherein said stacker belt supports documents delivered thereto at an angle offset from said guiding path whereby the leading edge of documents entering said stacker assembly strikes the bottom surface of the preceeding document fed to said stacker assembly and is guided therealong to move the stack upwardly.

14. The apparatus of claim 12 further comprising a movable stacker arm positioned to rest upon the top of said stack;

means responsive to the upward movement of the stacker arms as the stack increases in height for reducing the force exerted upon documents entering the stacker assembly by the stacker arm as the force exerted by the stack upon entering documents increases.

15. The apparatus of claim 14 further comprising switch means having a switch button;

a flexible runner positioned to overlie said button to prevent said button from being depressed by said stacker arm under normal stacking conditions;

said runner being adapted to flex and operate said button when struck by said stacker arm which is adapted to pivot rapidly due to a jam condition; said switch means being adapted to deenergize the device delivering documents to the stacker assembly.

16. The apparatus of claim 1 wherein said feed belt is provided with at least one continuous groove;

stripper means comprising a pivotally mounted wheel means positioned above said feed drum;

biasing means urging said wheel towards said feed drum;

means for rotating said wheel in a direction opposite the direction of rotation of said feed drum;

said wheel having a continuous circumferential portion extending into said feed belt groove to impart a curvature to documents passing between said wheel and said feed belt.

17. The apparatus of claim 16 wherein the periphery of said stripper wheel is formed of a material having a coefficient of friction which is less than the coefficient of friction of said feed belt.

18. Means for feeding documents comprising:

first and second rotatable rollers;

means for rotating one of said rollers;

a closed loop feed belt entrained about said first and second rollers and moved by the rotating rollers in a first direction;

a third eccentric idler roller positioned between said first and second rollers and driven by said moving feed belt to reciprocally move said feed belt transverse to said first direction;

stripper roller means including a stripper roller positioned adjacent said first roller;

means for rotating said stripper roller in a direction reverse that of the first roller positioned adjacent thereto;

the run of said feed belt extending between said eccentric roller and said first roller being adapted to move documents towards said first and third rollers which cooperate to pass only one document at a time through the nip between said feed belt and said stripper roller;

plural roller means positioned adjacent said first and second rollers and additional closed loop belt means entrained about said plural roller means for engaging documents passing said nip and moving between said first and second rollers to define a path together with said feed belt, along which documents are passed;

accelerating means adjacent the output end of said path for accelerating said documents as they enter the acceleration means to form a gap between a document entering the acceleration means and the document next fed thereto;

said feed belt having a continuous groove;

said stripper roller extending into said groove to form a curvature in documents as they pass therebetween.

19. The apparatus of claim 18 wherein the spacing between said additional belt means and said feed belt at said feed path output end is adapted to loosely guide documents therebetween enabling said acceleration means to begin accelrating a document before it passes out of the output end of the feed path without said feed belt and additional belt means exerting any drag on the documents being accelerated.

* * * * *